US008727489B2

(12) United States Patent
Hosono et al.

(10) Patent No.: US 8,727,489 B2
(45) Date of Patent: May 20, 2014

(54) FLUSHING METHOD FOR FLUID EJECTING APPARATUS

(75) Inventors: Satoru Hosono, Azumino (JP); Sayuri Kawakami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 253 days.

(21) Appl. No.: 12/234,254

(22) Filed: Sep. 19, 2008

(65) Prior Publication Data

US 2009/0079788 A1 Mar. 26, 2009

(30) Foreign Application Priority Data

Sep. 21, 2007 (JP) ..... 2007-244956

(51) Int. Cl.
*B41J 2/165* (2006.01)

(52) U.S. Cl.
USPC ..... 347/35

(58) Field of Classification Search
None
See application file for complete search history.

(56) References Cited

U.S. PATENT DOCUMENTS 6,161,912 A 12/2000 Kitahara et al.
6,802,589 B2 10/2004 Yonekubo
7,267,422 B2 * 9/2007 Brookmire et al. ..... 347/22
2005/0212851 A1 9/2005 Akase et al.
2006/0012624 A1 * 1/2006 Vanhooydonck ..... 347/15

FOREIGN PATENT DOCUMENTS

EP 1 287 996 A1 3/2003
JP 59-131464 7/1984
JP 2004-034607 2/2004
JP 2007-136989 6/2007

* cited by examiner

*Primary Examiner* — Alejandro Valencia
(74) *Attorney, Agent, or Firm* — Workman Nydegger

(57) ABSTRACT

A flushing method for a fluid ejecting apparatus that includes a pressure chamber filled with fluid, a pressure generating element on a surface of the pressure chamber that deforms the surface to change the pressure in the pressure chamber, and a nozzle in fluid communication with the pressure chamber that ejects the fluid, the method including repeatedly performing first flushing process a first period; and repeatedly performing a second flushing process with a second period. The flushing processes include causing the pressure chamber to expand into an expanded state, maintaining the expanded state, and contracting the pressure chamber from the expanded state, causing the fluid to be ejected from the nozzle. The amount of fluid ejected from the nozzle in the second flushing process is larger than the amount ejected in the first flushing process.

9 Claims, 20 Drawing Sheets

FIRST EXAMPLE EMBODIMENT

FIG. 2A FIRST EXAMPLE EMBODIMENT
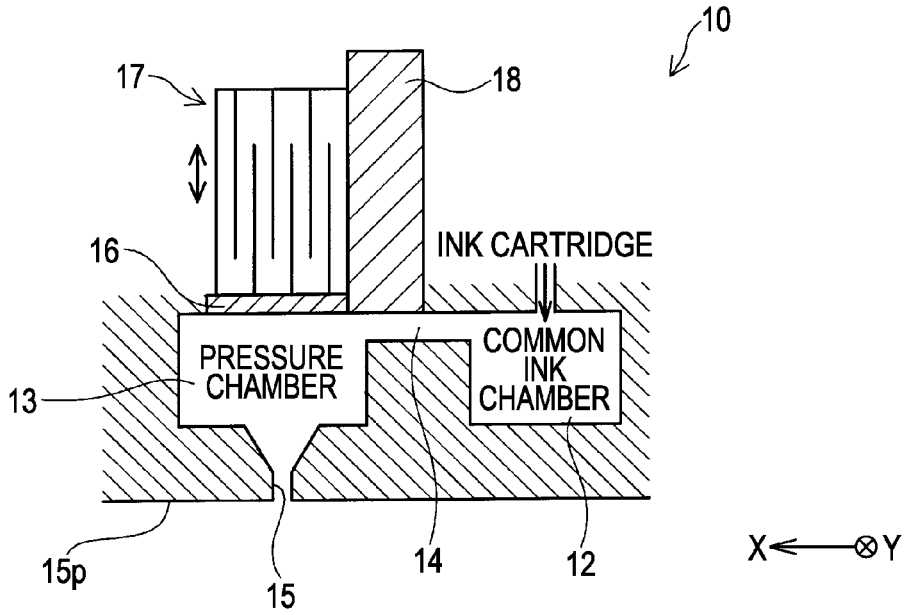
FIG. 2B FIRST EXAMPLE EMBODIMENT
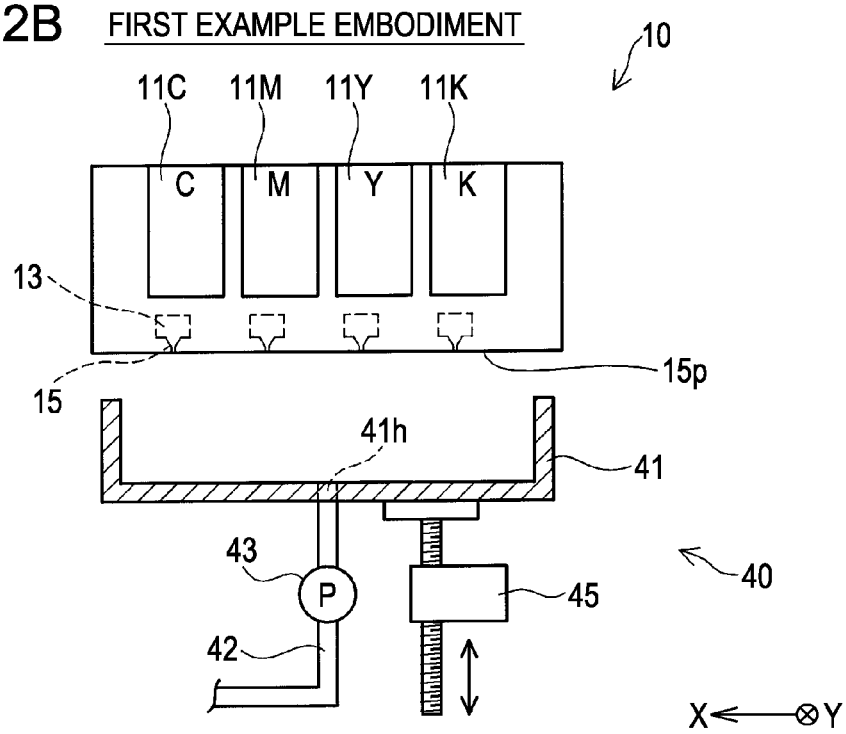

FIG. 5A BEFORE TIME $t_0$
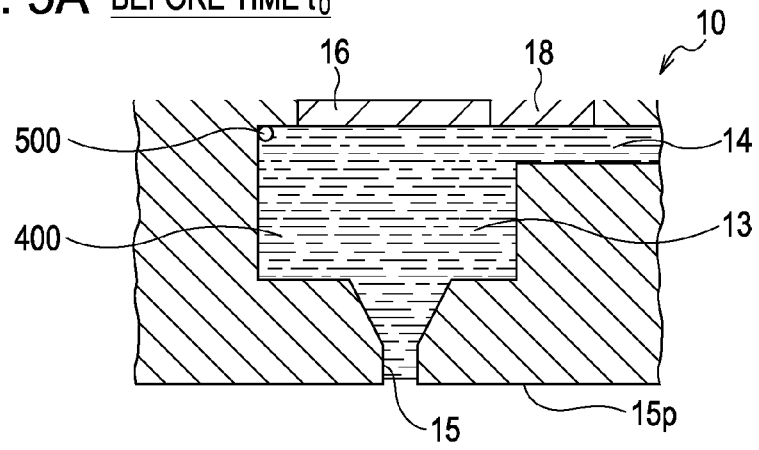
FIG. 5B FROM TIME $t_0$ TO TIME $t_2$
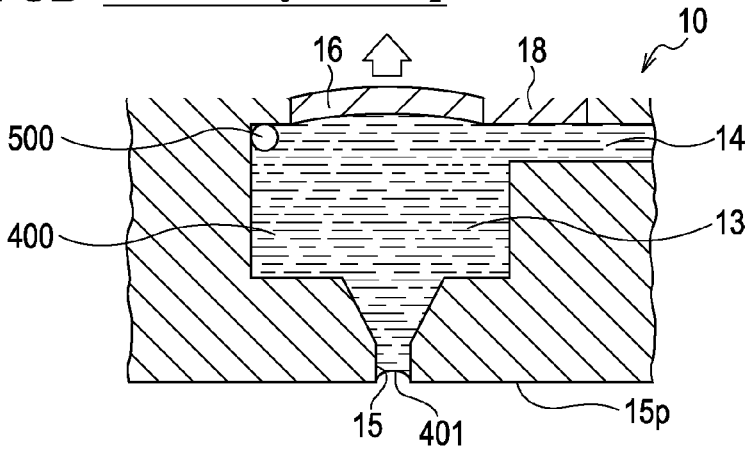
FIG. 5C FROM TIME $t_2$ TO TIME $t_3$
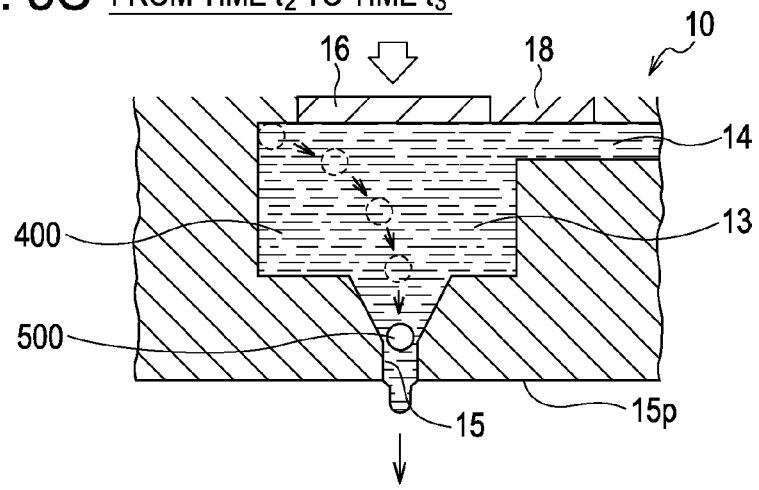

Tc = 6 [μs]

| PULSE WIDTH OF Pwc [μs] | 1.0 | 1.2 | 1.5 | 2.0 | 2.2 | 2.5 | 2.7 |
|---|---|---|---|---|---|---|---|
| (PULSE WIDTH)/Tc OF Pwc | 0.17 | 0.20 | 0.25 | 0.33 | 0.37 | 0.41 | 0.45 |
| DISCHARGE STATE | ◎ | ◎ | ◎ | ○ | ○ | △ | × |

SECOND EXAMPLE EMBODIMENT

FIG. 9 SECOND EXAMPLE EMBODIMENT
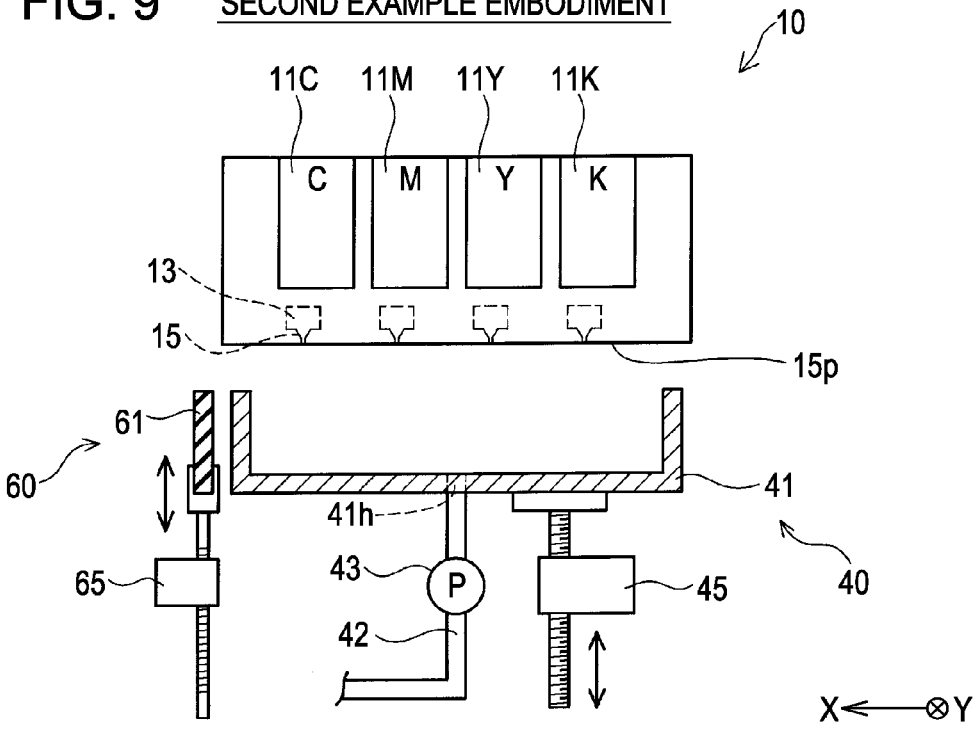
FIG. 10 SECOND EXAMPLE EMBODIMENT
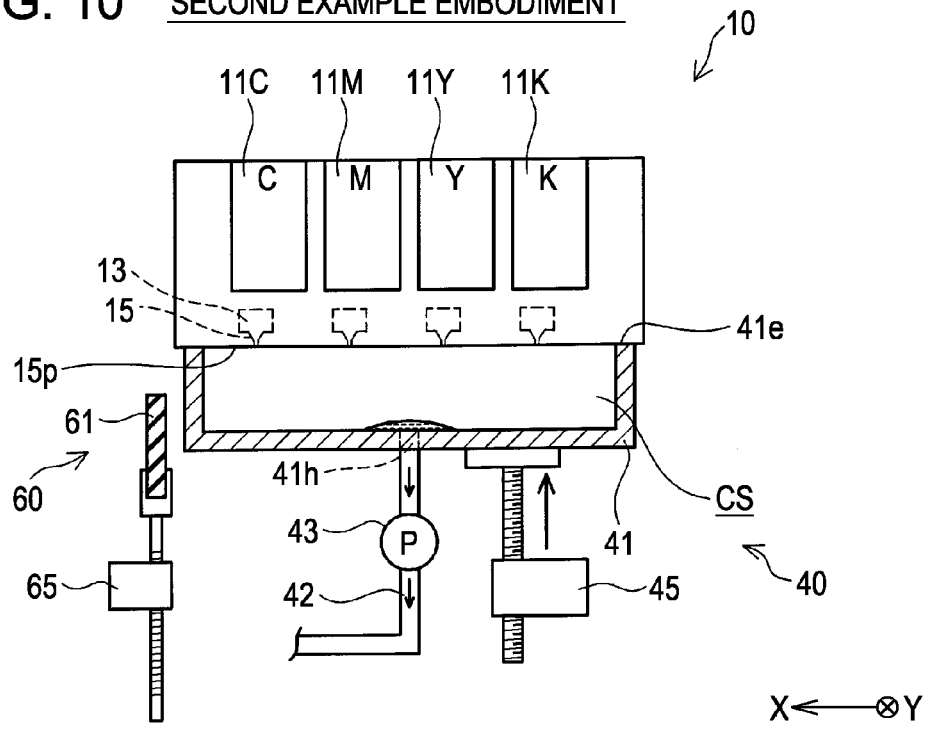

FIG. 11A SECOND EXAMPLE EMBODIMENT
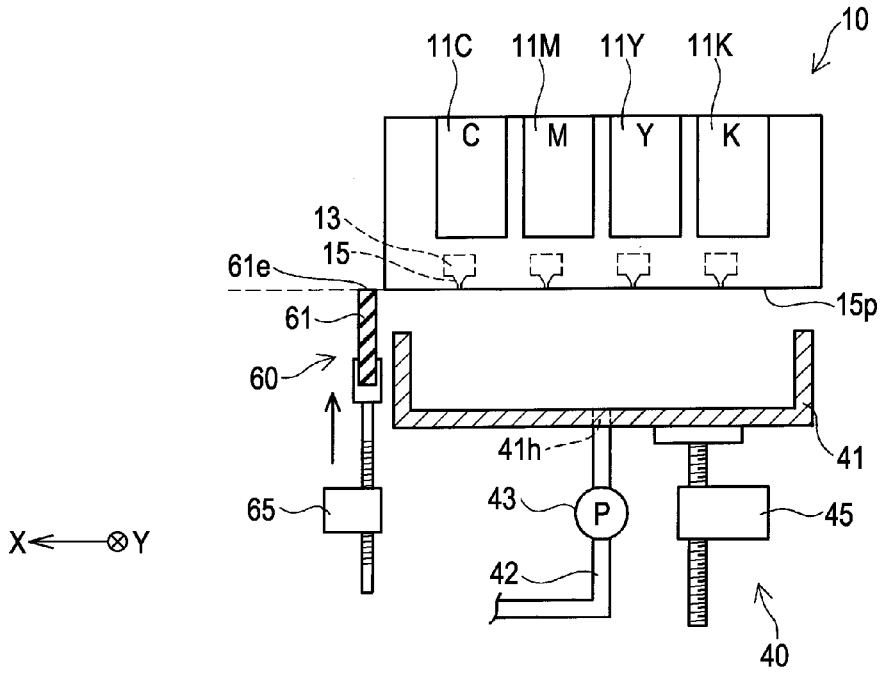
FIG. 11B SECOND EXAMPLE EMBODIMENT
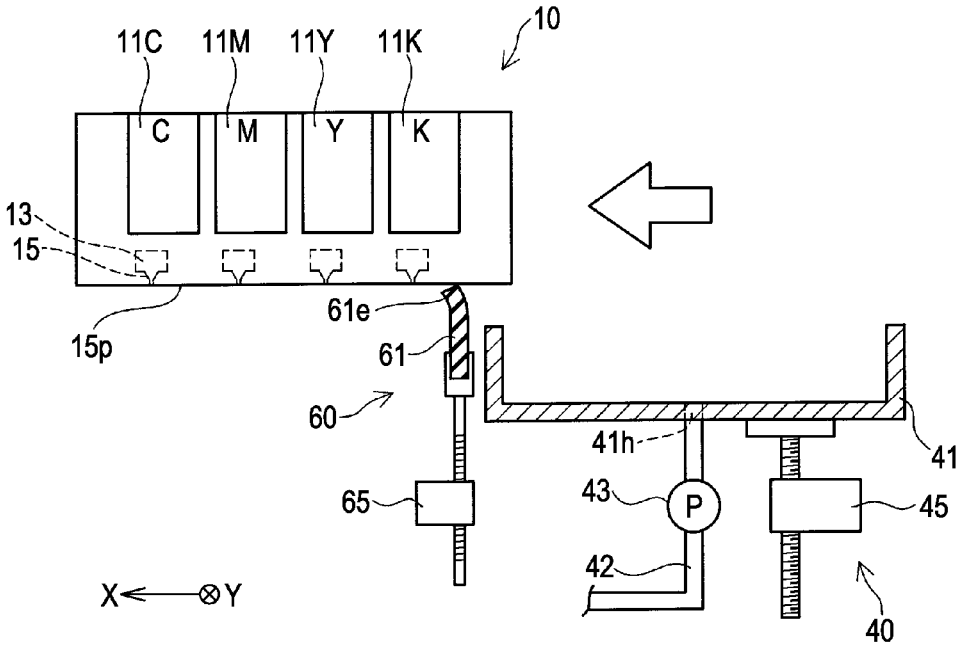

SECOND EXAMPLE EMBODIMENT

INITIAL FILLING PROCESS

SECOND EXAMPLE EMBODIMENT

INITIAL FILLING PROCESS

SECOND EXAMPLE EMBODIMENT

DRIVE WAVEFORM OF COLOR MIXTURE FLUSHING

THIRD EXAMPLE EMBODIMENT

THIRD EXAMPLE EMBODIMENT

FLOWCHART WHEN PRINTING IS PERFORMED

FOURTH EXAMPLE EMBODIMENT

TIMER CLEANING PROCESS

FIFTH EXAMPLE EMBODIMENT

TIMER CLEANING PROCESS

FIFTH EXAMPLE EMBODIMENT

FIFTH EXAMPLE EMBODIMENT

MANUAL CLEANING PROCESS

FIFTH EXAMPLE EMBODIMENT

MANUAL CLEANING PROCESS

SIXTH EXAMPLE EMBODIMENT

FLOWCHART WHEN PRINTING IS PERFORMED

FLUSHING METHOD FOR FLUID EJECTING APPARATUS

CROSS REFERENCES TO RELATED APPLICATIONS

The entire disclosure of Japanese Patent Application No. 2007-244956, filed Sep. 21, 2007 is expressly incorporated herein by reference.

BACKGROUND

1. Technical Field

The present invention relates to a maintenance method maintaining a fluid ejecting apparatus.

2. Related Art

An ink jet printer typically performs a printing operation by discharging or ejecting ink droplets from nozzles toward a surface of a sheet of paper. In ink jet printers, printing errors may occur as thickened ink adheres to nozzle openings as the solvent in the ink gradually evaporates or as pressure changes are generated in ink chambers by bubbles trapped in the ink chambers.

In order to consistently discharge ink droplets, various techniques for maintenance processes have been suggested, such as those described in Japanese Patent Application No. JP-A-2007-136989, Japanese Patent Application No. JP-A-59-131464, and the like. In the process described in JP-A-2007-136989, a negative pressure is generated by a pump when the nozzles are temporarily sealed with a cap. A pressure is applied to ink chambers using pressure generating elements, causing the nozzles to idly discharge ink droplets, thus performing a flushing process where thickened ink and/or bubbles are removed.

One problem with this process, however, is that even when the above maintenance process has been performed, it is difficult to generate a force that is sufficient to flush small, micro-diameter bubbles, such as those having a diameter of several tens μm, so it is difficult to completely remove any bubbles in the ink chambers.

These difficulties apply not only to ink jet printers but also to fluid ejecting apparatuses that eject fluid other than ink, including liquid and liquid materials formed of particles dispersed in a functional material. The above problem has not been addressed sufficiently.

BRIEF SUMMARY OF THE INVENTION

An advantage of some aspects of the invention is that it provides a technique for removing bubbles that cause poor ejection of nozzles in a fluid ejecting apparatus that ejects fluid.

A flushing method is performed in a fluid ejecting apparatus that comprises a pressure chamber that is filled with fluid, a pressure generating element that is provided on a surface of the pressure chamber which deforms the wall face in order to change a pressure in the pressure chamber, and a nozzle that is in fluid communication with the pressure chamber and that is used for ejecting the fluid. The flushing method comprises repeatedly performing a first flushing process with a first period and repeatedly performing a second flushing process with a second period. The first flushing process includes generating a negative pressure in the pressure chamber so that the pressure chamber is expanded into an expanded state, maintaining the expanded state, and contracting the pressure chamber, causing fluid to be discharged from the nozzle. The second flushing process includes generating a negative pressure in the pressure chamber, causing the pressure chamber to expand into an expanded state, maintaining the expanded state, and contracting the pressure chamber so a greater amount of fluid is discharged from the nozzle than is discharged in the first flushing process.

Note that the aspects of the invention may be implemented in various forms. For example, the aspects of the invention may be implemented in a form, such as a flushing method for a fluid ejecting apparatus and a fluid ejecting apparatus that implements the flushing method, a control method for a fluid ejecting apparatus and a control device for a fluid ejecting apparatus, a computer program that implements those methods or the functions of the fluid ejecting apparatuses, a recording medium that contains the computer program, and data signals that are realized in carrier waves that contain the computer program.

BRIEF DESCRIPTION OF THE DRAWINGS

The invention will be described with reference to the accompanying drawings, wherein like numbers reference like elements.

FIG. 2A and FIG. 2B are schematic cross-sectional views that show a configuration of a print head unit and cap unit according to the first embodiment;

FIG. 5A to FIG. 5C are schematic views that illustrate the mechanism of removing bubbles in the flushing process;

FIG. 9 is a schematic cross-sectional view that show a configuration of a print head unit, cap unit and wiper unit according to the second embodiment;

FIG. 10 is a schematic view that illustrates a vacuum operation in which ink is removed by the cap unit;

FIG. 11A and FIG. 11B are schematic views that illustrate a cleaning process in which a nozzle face is cleaned by the wiper unit;

DESCRIPTION OF EXEMPLARY EMBODIMENTS

Hereinafter, an embodiment of the invention will be described on the basis of embodiments in the following order.

A. First Embodiment
B. Second Embodiment
C. Third Embodiment
D. Fourth Embodiment
E. Fifth Embodiment
F. Sixth Embodiment
G. Alternative Embodiments

A. First Embodiment

Figure 1:
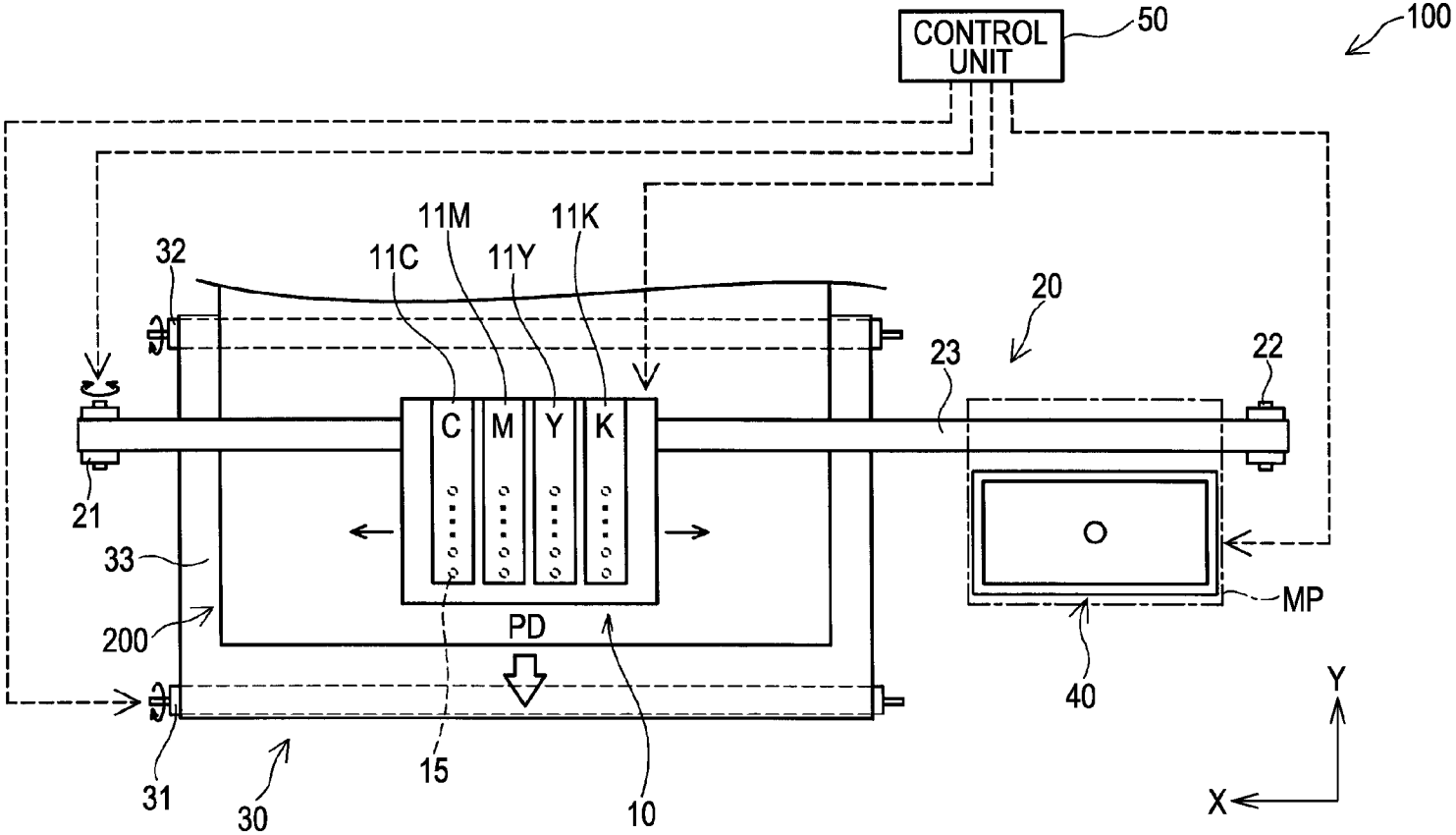
FIG. 1 is a schematic view that shows a configuration of an ink jet printer according to a first embodiment.

FIG. 1 is a schematic view that shows a configuration of an ink jet printer according to one embodiment of the invention. The ink jet printer 100 is an ink jet printing apparatus that forms an image by discharging ink droplets of a plurality of colors onto a surface of a sheet of paper in accordance with print data transmitted externally to the printer 100. The ink jet printer 100 includes a print head unit 10, a head driving unit 20, a paper transport unit 30, a cap unit 40, and a control unit 50.

The print head unit 10 has detachably mounted ink cartridges 11C, 11M, 11Y, and 11K of four colors consisting of cyan, yellow, magenta and black. When the ink jet printer 100 performs a printing process, the print head unit 10 repeats reciprocal movement in a direction which is perpendicular to the transport direction PD of a print sheet 200, shown as the X-direction, while discharging ink droplets of respective colors toward the paper surface. Note that the number of colors of ink cartridges mounted on the print head unit 10 is not limited to four; it may vary depending on the specific configuration of the printer, such as one or six.

The head driving unit 20 includes a first pulley 21, a second pulley 22 and a head driving belt 23. The two pulleys 21 and 22 are provided across the paper transport unit 30, and the head driving belt 23 is looped around the two pulleys 21 and 22. The first pulley 21 is driven to rotation by a motor (not shown) that is controlled by the control unit 50. The second pulley 22 rotates following the first pulley through the head driving belt 23. The print head unit 10 is fixed to the head driving belt 23. This allows the print head unit 10 to reciprocally move over a print face of the print sheet 200 in accordance with rotation of the first pulley 21.

The paper transport unit 30 includes a first paper transport roller 31, a second paper transport roller 32 and a paper transport belt 33 that is looped around the two paper transport rollers 31 and 32. The first paper transport roller 31 is driven for rotation by a motor (not shown) that is controlled by the control unit 50. The second paper transport roller 32 rotates following the first paper transport roller 31 through the paper transport belt 33. By so doing, the print sheet 200 is transported on the paper transport belt 33 in the transport direction PD during a printing process.

The cap unit 40 is arranged in parallel with the paper transport unit 30 within a region in which the print head unit 10 is movable. When performing a maintenance process described more fully below, the print head unit 10 moves to a region where a cap unit 40 is arranged, so that nozzles 15 provided on the bottom face of the print head unit 10, which are located opposite to the sheet of paper 200 can be sealed by the cap unit 40. The position of the print head unit 10 at this time is referred to as "maintenance position MP". The details of the cap unit 40 will be described later.

The control unit 50 is formed of a logical circuit that mainly includes a microcomputer, and is provided with a central processing unit (not shown), a storage device (not shown), and the like. The control unit 50 is connected to the above described print head unit 10, and the like, through signal lines and controls operation of the ink jet printer 100.

FIG. 2A is a schematic cross-sectional view that shows an internal structure of a discharge mechanism of the print head unit 10 for discharging ink droplets. FIG. 2A shows area surrounding a nozzle 15 of the print head unit 10 as viewed in the direction of arrow Y shown in FIG. 1. The print head unit 10 includes a common ink chamber 12 and pressure chambers 13, which are internal spaces that are filled with ink for each ink color.

Any one of the ink cartridges 11C, 11M, 11Y and 11K are mounted above the common ink chamber 12, and ink flows from the ink cartridge into the common ink chamber 12. The common ink chamber 12 is in fluid communication with the pressure chambers 13 through respective ink flow passages 14. Ink filled in the common ink chamber 12 flows into and out of the pressure chambers 13 through the ink flow passages 14. That is, the common ink chamber 12 serves as an ink buffer region for the pressure chambers 13.

A plurality of the nozzles 15 for discharging ink are provided at the bottom faces of the pressure chambers 13 so as to be arranged in parallel with one another in the sheet transport direction (the Y-direction). Hereinafter, the bottom face of the print head unit 10 is referred to as "nozzle face 15*p*". Each nozzle 15 is formed to be a micro-through-hole that gradually tapers from the pressure chamber 13 toward the nozzle face 15*p*.

A diaphragm 16 and a piezoelectric element 17 are provided opposite each nozzle 15 in the pressure chamber 13. The diaphragm 16 is a plate-like member that has a thick portion that is in contact with the piezoelectric element 17 and a thin, elastic portion provided around the thick portion. The thick portion vibrates in accordance with expansion and contraction of the piezoelectric element 17. Note that the thick portion and thin portion of the diaphragm 16 are not partitioned in the drawing.

The piezoelectric element 17 is a laminated piezoelectric vibrator that is formed by alternately laminating a piezoelectric body and an internal electrode, and comprises a longitudinal vibration mode piezoelectric vibrator that is able to expand and contract in a longitudinal direction (indicated by arrow) perpendicular to a laminated direction in accordance with a voltage applied to the piezoelectric vibrator. Each piezoelectric element 17 is fixed to a fixed base 18. The fixed base 18 is formed of a sufficiently rigid member that is able to efficiently transmit vibration of the piezoelectric element 17 to the diaphragm 16. With the above configuration, each piezoelectric element 17 applies a pressure to ink, with which the pressure chamber 13 is filled, through the diaphragm 16 in order to cause ink to discharge from the nozzle 15.

Incidentally, bubbles may be trapped in ink in the pressure chamber 13 when ink is initially filled from an ink cartridge or when a printing process is performed. The bubbles absorb the pressure change in the pressure chamber 13 applied by the piezoelectric element 17. This may produce so-called dot omission, that is, situations where ink droplets are not appropriately discharged from a portion of nozzles. In addition, ink may become clogged in a nozzle 15 because of thickened ink adhered to the nozzle 15 due to natural evaporation. For the above reasons, the ink jet printer 100 performs various maintenance processes when the printer 100 is not performing a printing process in order to appropriately discharge ink droplets from the nozzles.

The maintenance processes, for example, include so-called flushing processes, in which ink is idly discharged from the nozzles 15 to eject bubbles or thickened ink from the nozzles 15 together with ink droplets. Here, the "idle discharge" means discharging of ink droplets for a purpose other than printing.

FIG. 2B is a view that shows the ink jet printer 100 when the print head unit 10 is moved to the maintenance position MP (FIG. 1) for a maintenance process. Note that FIG. 2B does not show the components of the ink jet printer 100 other than those of the print head unit 10 and cap unit 40 for the sake of convenience.

The cap unit 40 includes a cap body 41, an ink drain line 42, a pump 43 and a driving mechanism 45. The cap body 41 is a pan-shaped member that is arranged so as to be able to cover the nozzle face 15*p*. The cap body 41 is able to receive waste ink discharged from the nozzles 15 during the flushing process.

A through-hole 41*h* is provided at the bottom center of the cap body 41. The ink drain line 42 is connected to the through-hole 41*h*. The pump 43 is provided in the ink drain line 42. The pump 43 is able to vacuum waste ink accumulated in the cap body 41. The waste ink is guided through the ink drain line 42 to a waste ink treatment portion (not shown) for treating waste ink. The driving mechanism 45 raises the cap body 41 to bring the cap body 41 into close contact with the nozzle face 15*p* when ink is vacuumed by the pump 43. Note that at the time of flushing, the cap body 41 is maintained in a position away from the nozzle face 15*p*.

Figure 3:
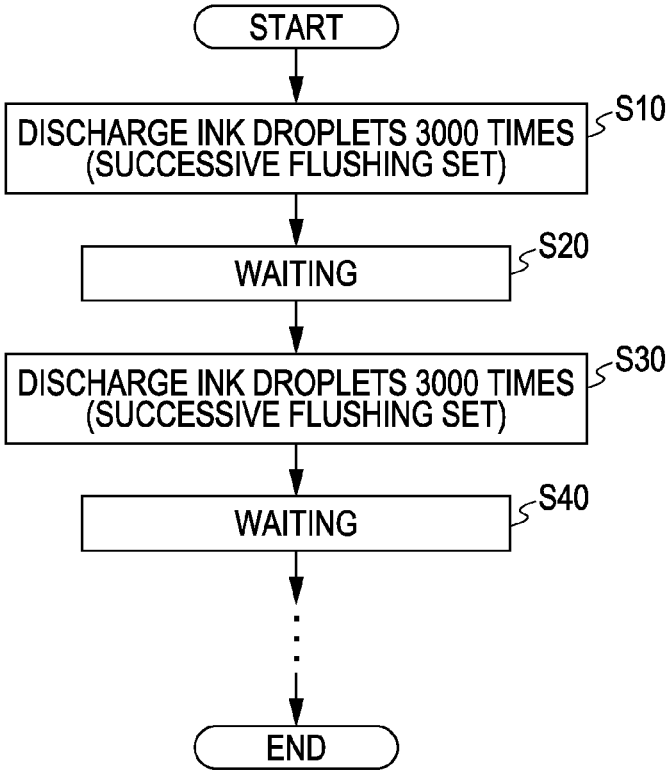
FIG. 3 is a flowchart that shows the steps of flushing process.

FIG. 3 is a flowchart that shows the steps of z bubble removal flushing process according to one embodiment of the invention. Here, the "bubble removal flushing process" means a flushing operation that is intended to remove bubbles.

In step S10, the control unit 50 causes each of the nozzles 15 to idly discharge ink droplets 3000 successive times. Hereinafter, the process of successively idly discharging ink droplets is termed as "successive flushing set". In step S20, the control unit 50 waits for a predetermined interval (for example, about one second) and then performs the successive flushing set again in the following step S30. Here, the interval is provided in step S20 in order to converge vibration of ink and vibration of the pressure chambers 13 due to the successive flushing set in the preceding process. By so doing, it is possible to effectively perform the following successive flushing set. Hereinafter, in the bubble removal flushing process, a series of processes consisting of the successive flushing set and the pausing interval are repeated a predetermined number of times.

Figure 4:
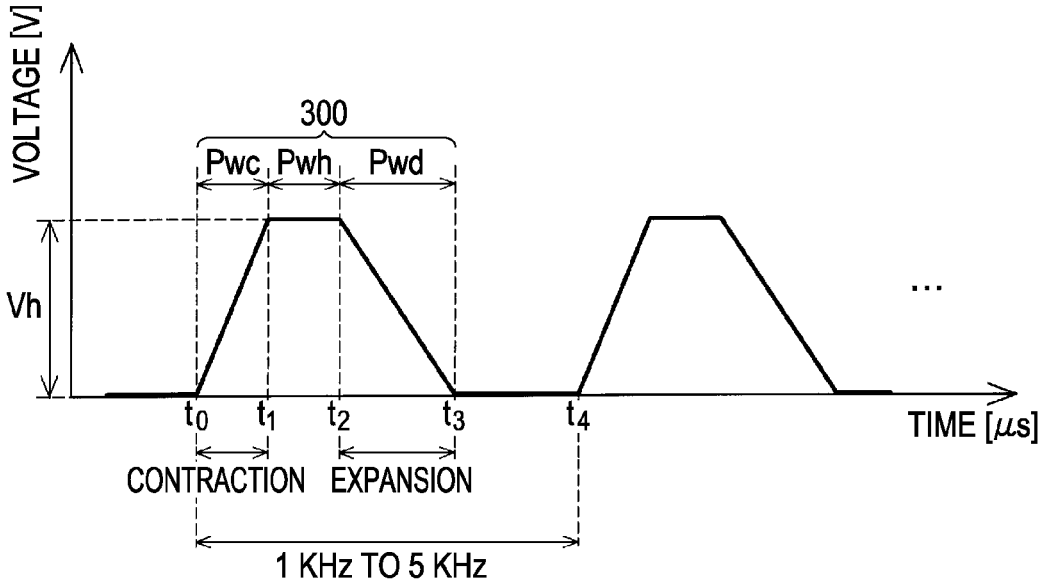
FIG. 4 is a graph that shows a drive pulse generated by a control unit in the flushing process.

FIG. 4 is a graph that shows a drive pulse 300 that the control unit 50 transmits to the piezoelectric element 17 of each nozzle 15 to discharge a single ink droplet in the successive flushing set of the bubble removal flushing process. The ordinate axis represents a voltage and the abscissa axis represents time.

The drive pulse 300 is a substantially trapezoidal pulse signal and includes a first pulse portion Pwc, a second pulse portion Pwh, and a third pulse portion Pwd. In the first pulse portion Pwc, a voltage value of the piezoelectric element 17 increases at a constant rate from a ground state (voltage value is 0) to Vh from time t0 to time t1. In the second pulse portion Pwh, a voltage value of the piezoelectric element 17 is kept constant at Vh from time t1 to time t2. In the third pulse portion Pwd, a voltage value of the piezoelectric element 17 returns at a constant rate from Vh to the ground state from time t2 to time t3.

Note that the frequency of the drive pulse 300 in the successive flushing set (frequency corresponding to a period from time t0 to time t4 shown in FIG. 4) is preferably in the range of 1 kHz to 5 kHz.

FIG. 5A to FIG. 5C are schematic views that schematically show operation of the print head unit 10 on the drive pulse 300. FIG. 5A to FIG. 5C are enlarged views of the pressure chamber 13 of the print head unit 10 shown in FIG. 2A. The piezoelectric element 17 and the common ink chamber 12 are not shown in FIGS. 5A-5C.

FIG. 5A shows a state of the pressure chamber 13 before receiving the drive pulse 300 (prior to time t0). The pressure chamber 13 is filled with ink 400, and a bubble 500 is trapped in the ink 400. Note that the bubble 500 tends to accumulate in a region located at a higher elevation in the pressure chamber 13 which is opposite to the ink flow passage 14.

FIG. 5B shows a state of the pressure chamber 13 from time t0 to time t2 shown in FIG. 4. The piezoelectric element 17, when receiving the first pulse portion Pwc between time t0 and time t1, contracts in accordance with an increase in applied voltage. Then, as shown in FIG. 5B, the diaphragm 16 bends away from the pressure chamber 13 (in the direction of the arrow), and a negative pressure is applied to the ink 400 in the pressure chamber 13. Note that a meniscus 401 formed at the nozzle 15 at this time increases the degree of bending in the same direction as that of the diaphragm 16. Then, the diaphragm 16 is kept bent from time t1 to time t2. Between time t0 and time t2, the diameter of the bubble 500 increases with a decrease in pressure in the pressure chamber 13.

FIG. 5C shows a state of the pressure chamber 13 from time t2 to time t3. Owing to the third pulse portion Pwd of the drive pulse 300, a voltage value applied to the piezoelectric element 17 returns to a ground value (FIG. 4) and the piezoelectric element 17 also expands to return to a normal state. That is, the diaphragm 16 returns from the bent state to a flat state. By so doing, the ink 400 in the pressure chamber 13 is applied with a pressure from the diaphragm 16 and then discharged from the nozzle 15. At this time, the bubble 500 also gradually approaches to the nozzle 15 in accordance with the discharge of the ink, and is finally ejected outward from the nozzle 15. FIG. 5C shows the location of the bubble 500 moving toward the nozzle 15 in accordance with a large number of the drive pulses 300 being generated.

Here, as described with reference to FIG. 5B, according to the drive pulse 300, the diameter of the bubble 500 may be increased between time t0 to time t1, and in accordance with the increase in diameter, a even larger force may be applied from the diaphragm 16 to the bubble 500. Thus, according to the drive pulse 300, for example, a bubble having a micro-diameter may also be easily discharged.

As can be understood from the above description, by decreasing the pressure in the pressure chamber 13 to increase the diameter of the bubble 500 as much as possible, it is possible to further reliably discharge and remove the bubble 500. Thus, the pulse width of the first pulse portion Pwc (FIG. 4) of the drive pulse 300 is desirably set to be equal to or smaller than half the Helmholtz resonance period Tc of the ink 400 in the pressure chamber 13. Here, the "Helmholtz resonance period Tc" is a natural vibration period when a vibrational wave generated through increase and decrease in volume of the pressure chamber 13 propagates through the ink 400 in the pressure chamber 13, and is determined based on the shapes of the pressure chamber 13, ink flow passage 14 and nozzle 15.

Figures 6A, 6B:
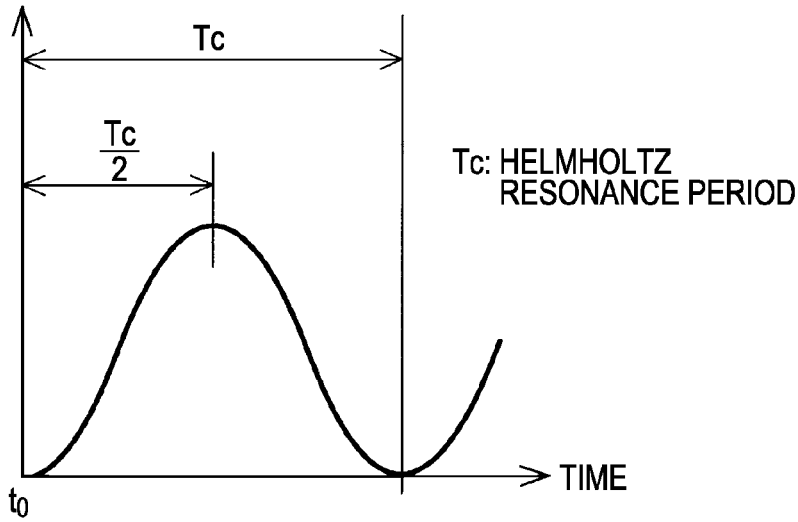
FIG. 6A and FIG. 6B are a graph and a table of experimental results, illustrating a desirable pulse width for a first pulse portion.

FIG. 6A is a graph that shows a state of ink vibration in conformity with the Helmholtz resonance period Tc. Theoretically, it may be understood that as the pressure in the pressure chamber 13 is decreased from time t0 over a period of about half the Helmholtz resonance period Tc, the vibration of the ink is at its maximum state. Then, by setting the pulse width of the first pulse portion Pwc to be equal to or smaller than half the Helmholtz resonance period Tc, a further large negative pressure may be generated in the pressure chamber 13, and the diameter of the bubble 500 may be increased.

FIG. 6B is a table that shows the experimental results when a discharge state is checked when a bubble removal flushing process is performed with different pulse widths of the first pulse portion Pwc in the print head unit having a Helmholtz resonance period Tc of 6 μs. Note that the double circle in the table represents that all the bubbles have been removed from the nozzles during a bubble removal flushing process and no dot omission has been detected. The single circle in the table represents that bubbles remain and dot omissions occur in at least one and no more than 30 percent of nozzles after the bubble removal flushing process. In addition, the triangle represents that dot omissions occurred in no more than 50 percent of nozzles, and the cross represents that dot omission occurred in more than 50 percent of nozzles after the bubble removal flushing process.

As shown in the table, the pulse width of the first pulse portion Pwc is preferably less than or equal to 0.4 times the Helmholtz resonance period Tc, and, particularly, is preferably one-third or less of the Helmholtz resonance period Tc or 0.3 times or less of the Helmholtz resonance period Tc. However, it is described with reference to FIG. 6A that the pulse width is set to be equal to or smaller than half the Helmholtz resonance period Tc. This difference may be regarded as the time at which the diameter of a bubble varies by resonating with the piezoelectric element 17 because of the natural frequency of the bubble, which will be described more fully below. Note that it is preferable that the pulse width of the first pulse portion Pwc is as short as possible. Preferably, the pulse width is set to about 1.5 μs, depending on the response, and the like, of the piezoelectric element 17 to the drive pulse.

Figure 7:
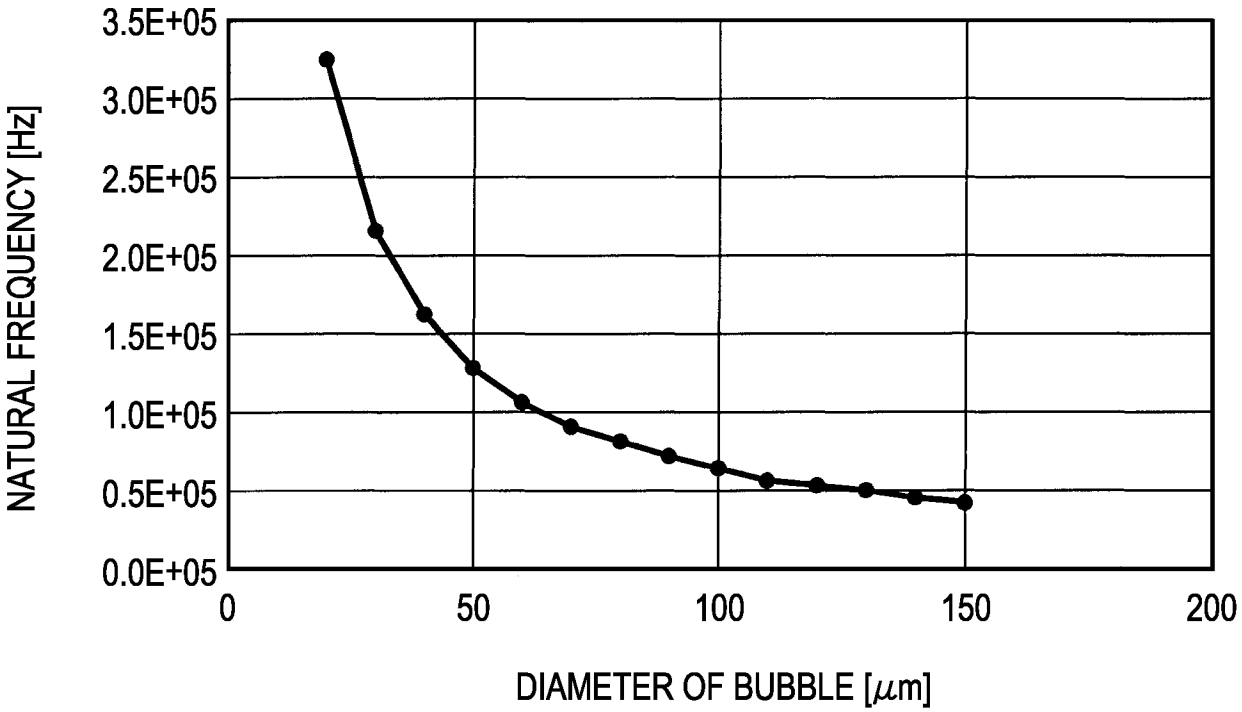
FIG. 7 is a graph that shows the relationship between a diameter of a bubble and a natural frequency of the bubble.

FIG. 7 is a graph that shows the relationship between a diameter of a bubble and a natural frequency of the bubble. As shown in the graph, the natural frequency of the bubble decreases inversely with the diameter of the bubble. That is, an optimum contraction cycle (pulse widths of the first and second pulse portions Pwc and Pwh) of the piezoelectric element 17 for maximally increasing the diameter of the bubble varies depending on the diameter of the bubble.

As described above, because the pulse width of the first pulse portion Pwc is set to a value according to the Helmholtz resonance period Tc, the contraction cycle of the piezoelectric element 17 is desirably set to a value according to the natural frequency of the bubble by adjusting the pulse width of the second pulse portion Pwh. By so doing, in the following third pulse portion Pwd, it is possible to discharge an ink droplet at the time when the diameter of the bubble is further increased. Note that the pulse width of the second pulse portion Pwh may be regarded as waiting time until the bubble initiates resonance.

Incidentally, in the present embodiment, the pulse width of the second pulse portion Pwh is set to a different value for each successive flushing set (step S10, S30, or the like, in FIG. 3). More specifically, the pulse width of the second pulse portion Pwh of the drive pulse 300 generated in step S30 is set to be shorter than the drive pulse 300 that generated in step S10, and subsequently, the pulse width is set to be shorter for each successive flushing set. This means that every time the successive flushing set is repeated, a removal target diameter of a bubble is reduced. By so doing, the bubble removal flushing is able to further reliably perform removal of bubbles.

Furthermore, the pulse width of the third pulse portion Pwd of the drive pulse 300 (FIG. 4) is desirably set to be substantially equal to the natural frequency Ta of the piezoelectric element 17. This is because the set pulse width of the third pulse portion Pwd suppresses the excessively continuous vibration of the piezoelectric element 17 that has received the drive pulse 300. If the piezoelectric element 17 continues vibration more than necessary, a micro-droplet of ink may be undesirably discharged from the nozzle 15.

In the ink jet printer 100 that performs bubble removal flushing using the drive pulse 300, a micro-bubble that is present in the pressure chamber 13 may also be discharged from the nozzle 15 by increasing its diameter. In addition, because the drive pulses 300 that are intended for bubbles having different diameters are sequentially generated, it is possible to further effectively perform removal of bubbles.

B. Second Embodiment

Figure 8:
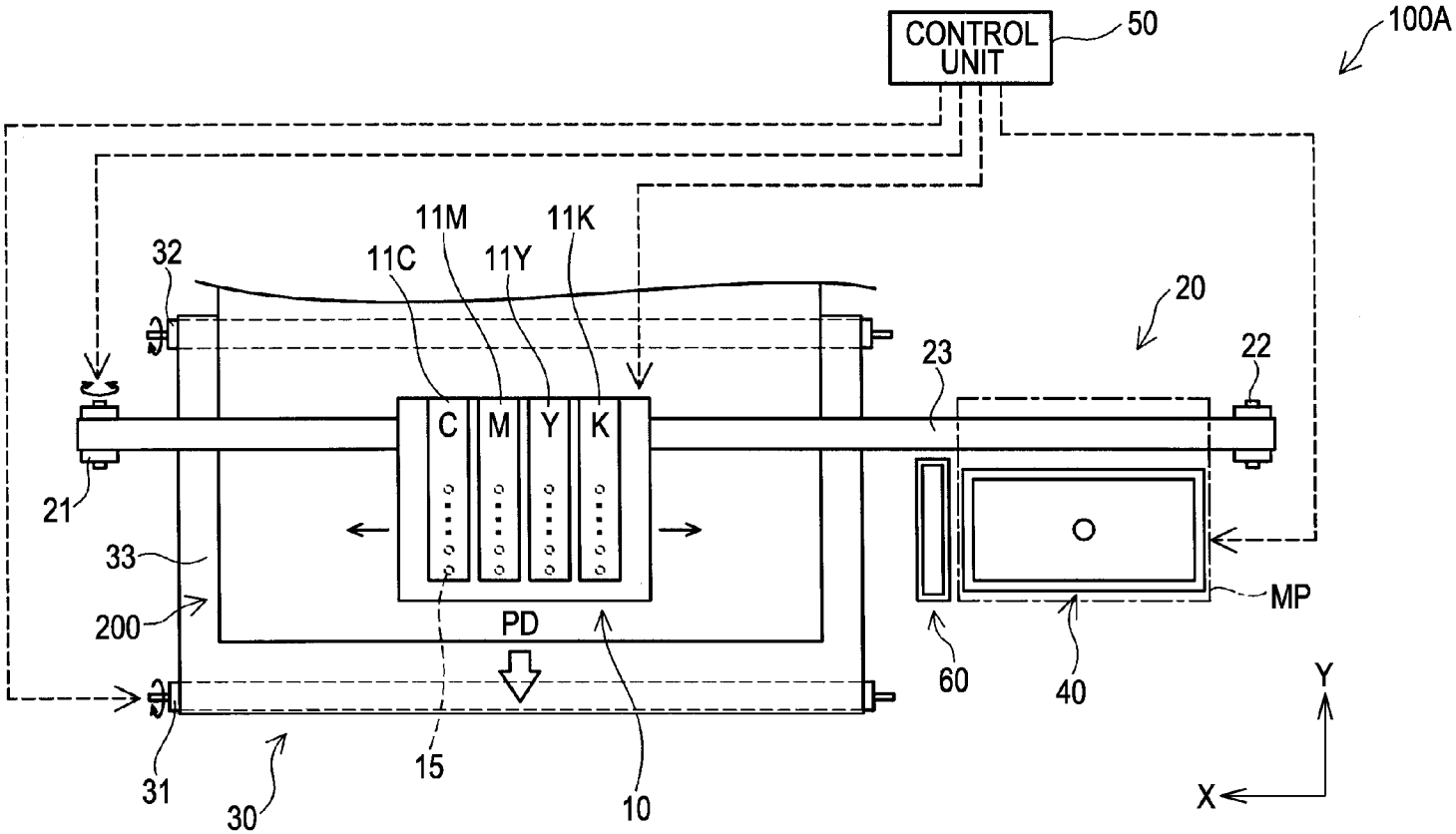
FIG. 8 is a schematic view that shows a configuration of an ink jet printer according to a second embodiment.

FIG. 8 is a schematic view that shows a configuration of an ink jet printer 100A according to a second embodiment of the invention. FIG. 8 shows substantially the same as that of FIG. 1 except that a wiper unit 60 is provided between the paper transport unit 30 and the cap unit 40.

FIG. 9 is a schematic view of the ink jet printer 100A when the print head unit 10 is moved to the maintenance position MP for maintenance process as viewed in the direction of arrow Y in FIG. 8. FIG. 9 shows substantially the same as that of FIG. 2 except that the wiper unit 60 is added.

The wiper unit 60 includes a wiper blade 61 that is formed of rubber or flexible resin. The wiper blade 61 is capable of being moved vertically by means of a driving mechanism 65.

FIG. 10 shows a state in which the cap unit 40 hermetically seals the nozzles 15 in such a manner that the end face 41*e* of the cap body 41 of the cap unit 40 contacts the nozzle face 15*p* of the print head unit 10. The cap unit 40 vacuums or removes ink from the nozzles 15 in such a manner that the pump 43 applies a negative pressure in a space covered with the cap body 41 (ink vacuuming process). Hereinafter, the space closed by the cap body 41 is termed as "cap closed space CS".

FIG. 11A and FIG. 11B are schematic views that illustrate the process of wiping the nozzle face 15*p* by the wiper unit 60 during the wiping process. The nozzle face 15*p* can be covered with thickened ink adhered to nozzle openings. In addition, at the time of the above ink vacuuming process, ink may be adhered to the nozzle face 15*p* due to contact of the nozzle face 15*p* with the end face 41*e* of the cap body 41. Ink accumulated on the nozzle face 15*p* causes poor performance of the print head unit 10. For this reason, the nozzle face 15*p* is cleaned through wiping process using the wiper unit 60.

FIG. 11A shows a state in which the distal end portion 61*e* of the wiper blade 61 is moved upward (indicated by arrow) to substantially the same level as that of the nozzle face 15*p*. Note that at this time, the cap body 41 of the cap unit 40 is not in contact with the nozzle face 15*p*. FIG. 11B shows a state in which the print head unit 10 is moved in the direction of arrow X while the wiper blade 61 is in contact with the nozzle face 15*p*. In this way, by moving the distal end portion 61*e* of the wiper blade 61 on the nozzle face 15*p*, it is possible to wipe off any ink that has accumulated on the nozzle face 15*p*.

Figure 12:
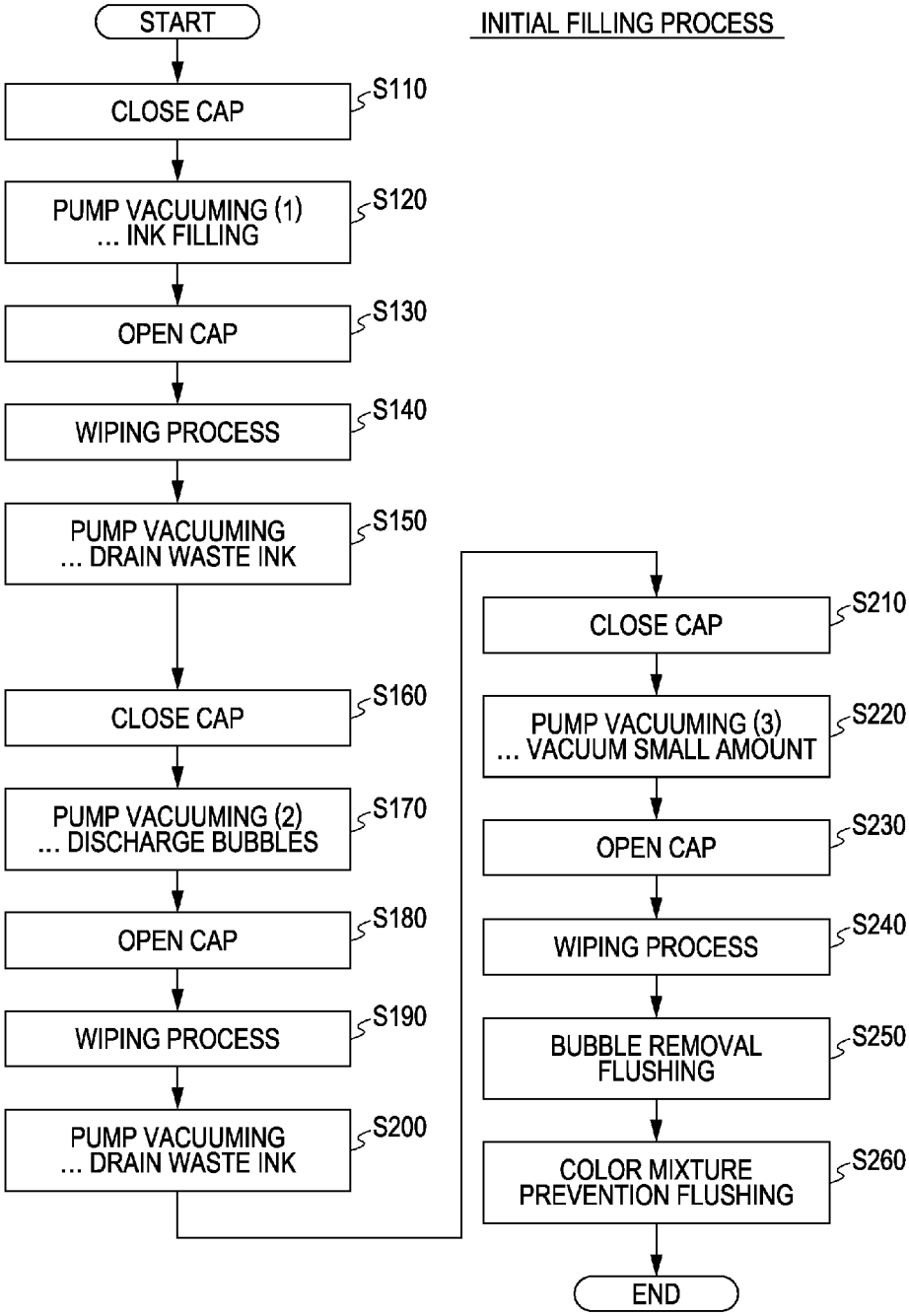
FIG. 12 is a flowchart that shows the steps of initial filling process according to the second embodiment.

FIG. 12 is a flowchart that shows the steps of the initial filling process. Here, the "initial filling process" means a process in which, when at least one of the ink cartridges 11C, 11M, 11Y, and 11K mounted on the print head unit 10 is replaced, the common ink chamber 12 and the pressure chambers 13 connected to the ink cartridge are filled with ink. Note that replacement of an ink cartridge and initial filling process are performed in a state where the print head unit 10 is at the maintenance position MP.

In step S110 to step S120, the ink vacuuming process described with reference to FIG. 10 is performed. Through the above process, the pressure chambers 13 are filled with ink. At this time, the cap unit 40 has adhered ink that has been vacuumed from the nozzles 15.

After that, the negative pressure applied to the cap closed space CS (FIG. 10) is released, and in step S130, the cap unit 40 is moved to an initial position where the nozzles 15 are uncovered. In step S140, the wiping process of wiping the nozzle face using the wiper unit 60 is performed and in step S150, the pump 43, which is adhered to the cap unit 40, is operated in order to drain waste ink through the ink drain line 42. Hereinafter, steps S110 to S150 is referred to as the "first filling process".

In step S160 to step S200, the same steps of the first filling process are repeated in a second filling process. Furthermore, in the following step S210 to step S240 as well, the same processes as those of the first and second filling processes are performed; however, the amount of vacuuming by the pump 43 during the third filling process may be smaller than those of the previous processes. The filling process of step S210 to step S240 is particularly termed as "small amount filling process".

Figure 13:
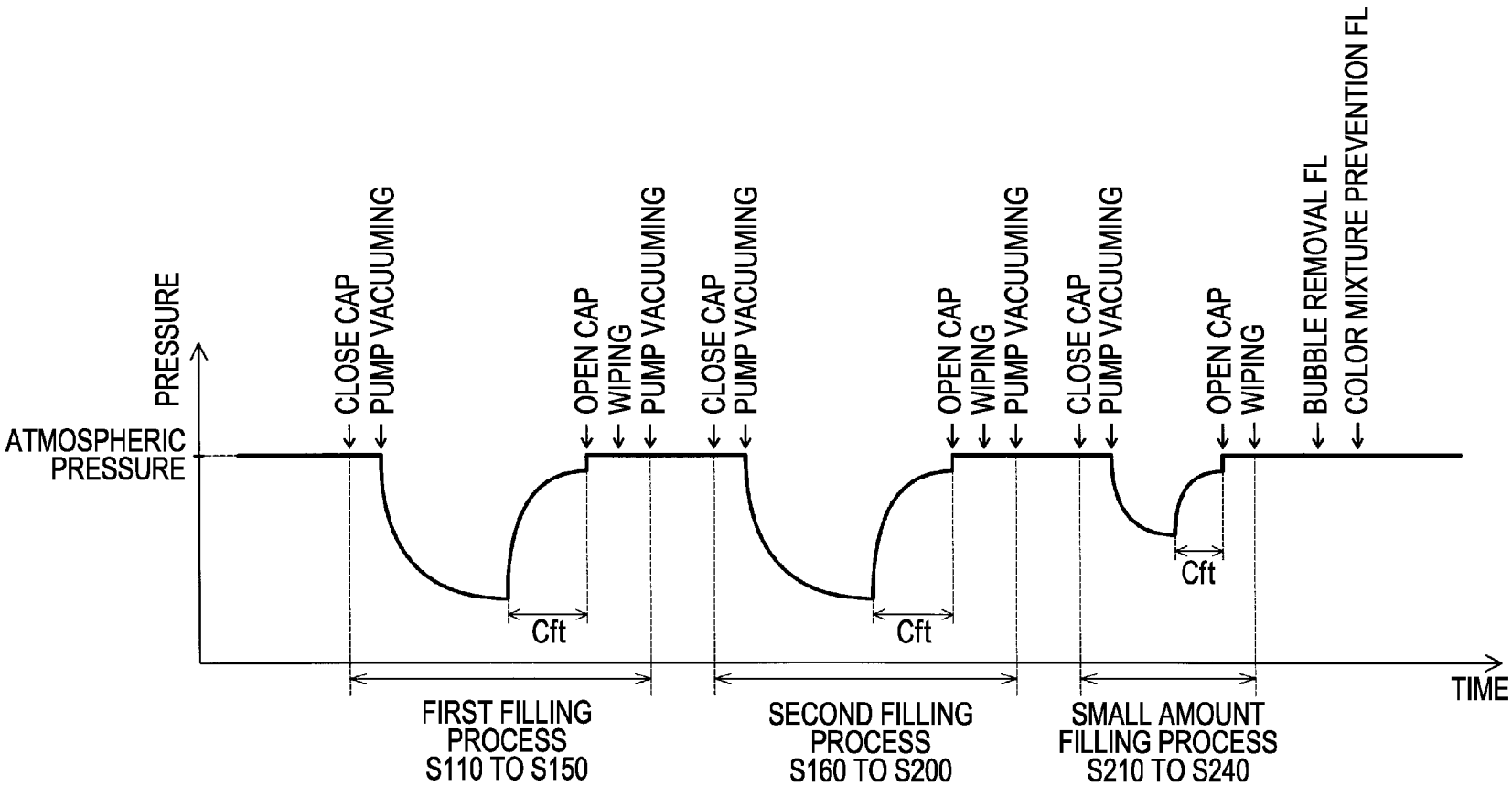
FIG. 13 is a graph that shows a pressure change in a cap closed space when the initial filling process is being performed.

FIG. 13 is a graph that shows a change in pressure over time in the cap closed space CS (FIG. 10) during the initial filling process. The ink vacuuming process is performed multiple times in order to further reliably perform ink filling by reducing bubbles trapped in an ink filling region from the common ink chamber 12 to the pressure chambers 13. However, bubbles may still possibly be trapped in the pressure chambers 13.

For this reason, in step S250 (shown in FIG. 12), of the bubble removal flushing process that uses the drive pulse 300 described in the first embodiment is performed. By so doing, bubbles in the pressure chambers 13 are further reliably removed to suppress occurrence of dot omission in the nozzles 15.

In step S260, a color mixture prevention flushing process is performed, which is different from the bubble removal flushing in step S250. At the time of the above described ink vacuuming process, in some time frames Cft (FIG. 13), the pressure in the cap closed space CS increases from a negative pressure to about atmospheric pressure. At this time, within the cap closed space CS (FIG. 10), misted or vaporized ink may return back toward the nozzle face 15*p*. This may cause ink, which is different in color from discharged ink, to be mixed into the nozzles 15. In addition, in the wiping process, when the nozzle face 15*p* is wiped off by the wiper blade 61, different color ink may be mixed into the nozzles 15. The color mixture prevention flushing process is a flushing operation that discards different color ink that has become mixed into the nozzles 15.

Figure 14:
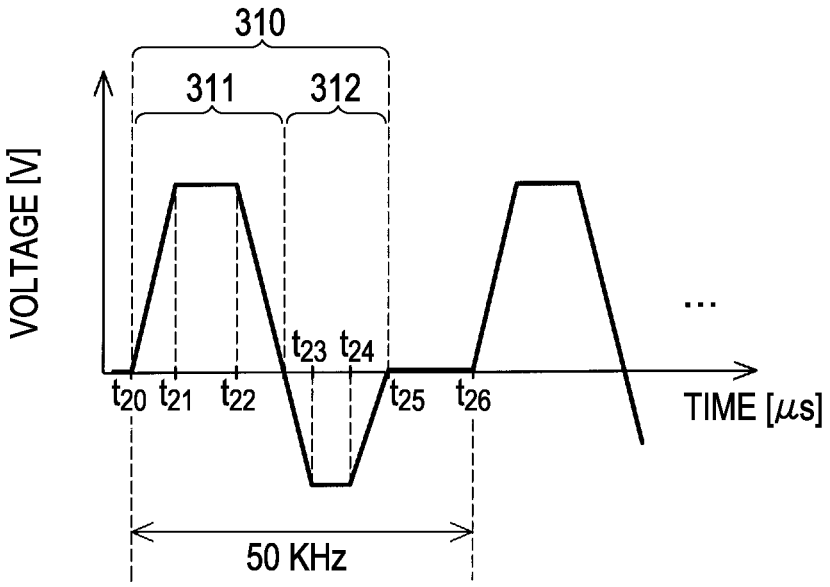
FIG. 14 is a graph that shows a drive pulse generated by the control unit in a color mixture prevention flushing process.

FIG. 14 is a graph that shows a drive pulse that the control unit 50 generates for the piezoelectric elements 17 in the color mixture prevention flushing process. The drive pulse 310, which is different from the drive pulse 300 (FIG. 4) in the bubble removal flushing, is used to discharge a large amount of ink at a time.

The drive pulse 310 includes a first pulse portion (from time t20 to time t21) that increases the voltage at substantially a constant rate from a ground voltage and a second pulse portion (from time t21 to time t22) that maintains a constant voltage for a predetermined period of time. In addition, the drive pulse 310 further includes a third pulse portion (from time t22 to time t23) that decreases the voltage at substantially a constant rate to a negative voltage, a fourth pulse portion (from time t23 to time t24) that maintains a constant negative voltage for a predetermined period of time, and a fifth pulse portion (from time t24 to time t25) that increases the voltage at substantially a constant rate back to the ground voltage. That is, the drive pulse 310 includes a first substantially trapezoidal pulse 311 that generates a positive voltage and a second substantially trapezoidal pulse 312 that generates a negative voltage.

The drive pulse 310 includes the second substantially trapezoidal pulse 312 in order to suppress the occurrence of excessive vibration in an ink surface in the nozzle 15 and perform successive ink discharges in a short period of time. For example, in the color mixture prevention flushing process, the control unit 50 is able to generate the drive pulse 310 multiple times in a row at a frequency of about 50 kHz, at a frequency corresponding to a period from time t20 to time t26.

In this way, in the initial filling process, the bubble removal flushing process (step S250) is performed before the color mixture prevention flushing process (step S260 in FIG. 12). Because the color mixture prevention flushing process is desirably performed when ink droplets are discharged from all the nozzles 15, by suppressing the occurrence of dot omission through the previous bubble removal flushing process, it is possible to effectively perform a color mixture prevention flushing process.

C. Third Embodiment

Figure 15:
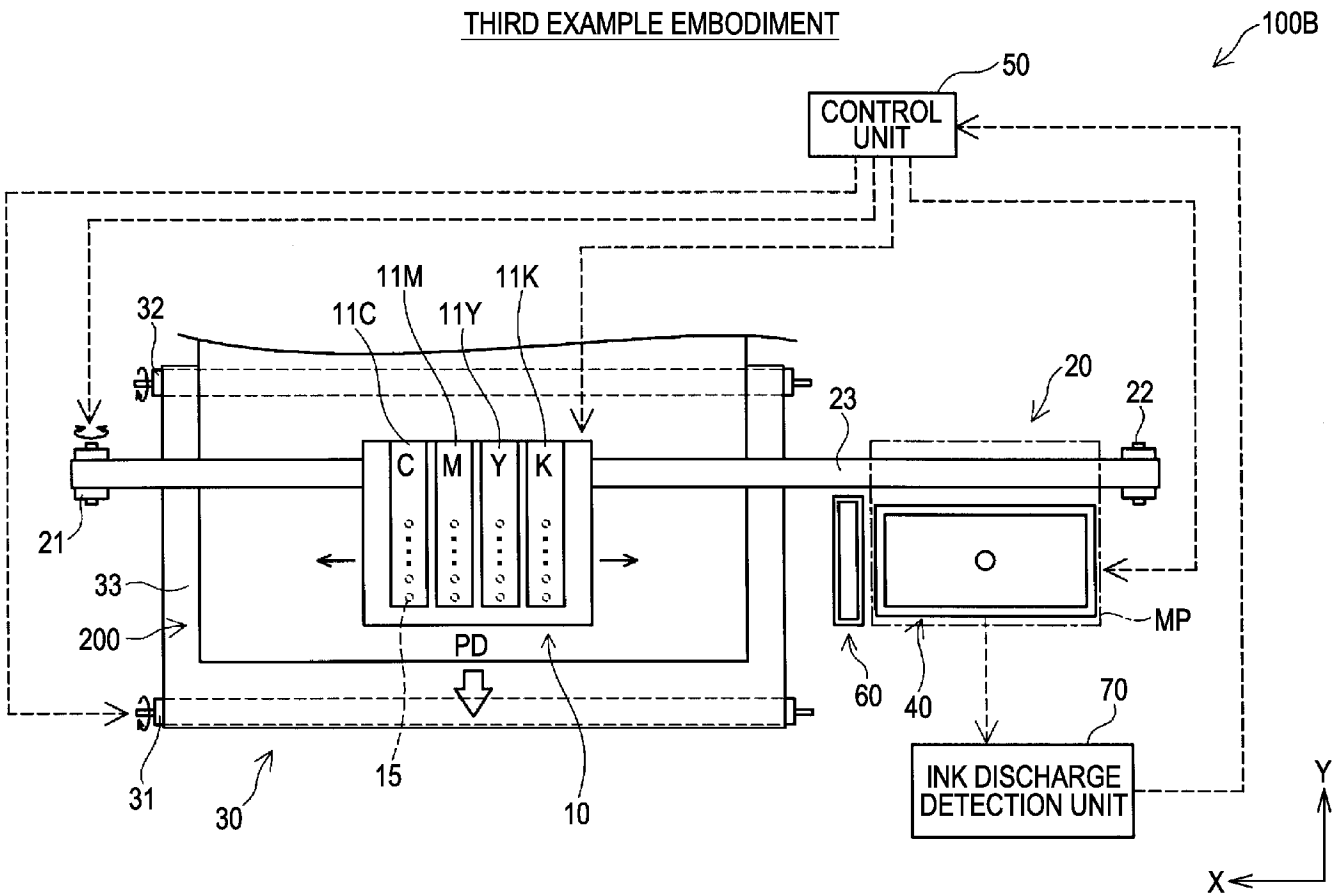
FIG. 15 is a schematic view that shows a configuration of an ink jet printer according to a third embodiment.

FIG. 15 is a schematic view that shows a configuration of an ink jet printer 100B according to a third embodiment of the invention. FIG. 15 shows substantially the same as that of FIG. 8 except that an ink discharge detection unit 70 is provided for detecting discharge of ink from the nozzles 15. The ink discharge detection unit 70 receives an output signal from a sensor provided on the cap unit 40 and transmits a detected result to the control unit 50.

The ink discharge detection unit 70 may be, for example, configured to electrically detect the discharge of ink. Specifically, when the print head unit 10 is placed at the maintenance position MP, ink is discharged in a state where electric charge is applied between the nozzle face 15*p* and the cap body 41 of the cap unit 40 to thereby detect a variation in the amount of electric charge by the sensor. As the amount of ink discharged decreases, the variation in the amount of electric charge is smaller than a predetermined value, so that it may be determined that dot omissions are occurring. Note that the ink discharge detection unit 70 may be configured to detect discharged ink droplets by an optical sensor or may be configured to perform detection through another method.

Figure 16:
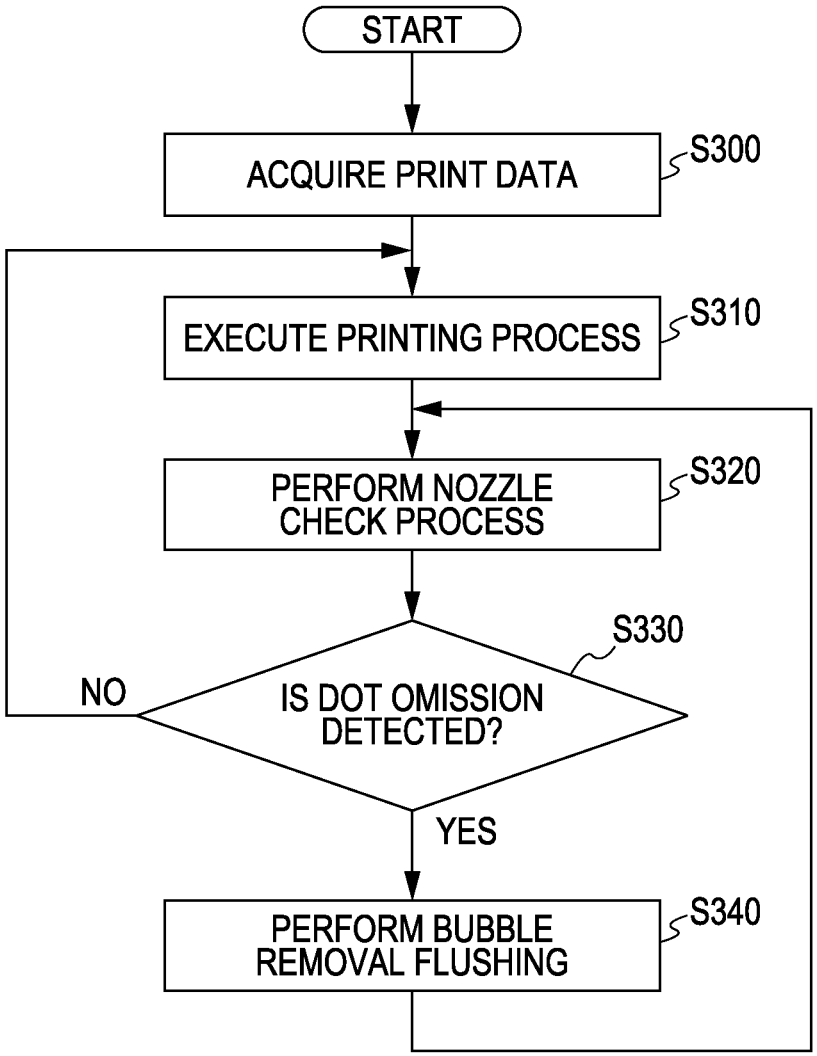
FIG. 16 is a flowchart that shows the steps when printing is being performed by the ink jet printer according to the third embodiment.

FIG. 16 is a flowchart that shows the steps performed by the control unit 50 when a printing process is being performed. At step S300, the control unit 50, upon receiving print data together with print executive instruction from an external computer, or the like, drives the print head unit 10, the head driving unit 20, and the paper transport unit 30 in accordance with the print data in order to perform a printing process in step S310.

After a predetermined time has elapsed from the initiation of printing, the control unit 50 temporarily interrupts the printing process, and moves the print head unit 10 to the maintenance position MP, and then performs nozzle checking by discharging ink droplets from all the nozzles 15 (step S320). At this time, when it is detected that normal ink droplets are discharged from all the nozzles, that is, when no dot omission is detected (step S330), the control unit 50 continues the printing process (step S310).

On the other hand, at step S330, when the ink discharge detection unit 70 detects dot omission (step S330) the control unit 50 performs a bubble removal flushing process (step S340). Note that the bubble removal flushing process is performed as in the same manner as the process described in the first embodiment (FIG. 3 and FIG. 4).

After the bubble removal flushing process is performed, the control unit 50 performs nozzle checking process again (step S320) to verify performance recovery of the ink jet printer 100B. The control unit 50 repeatedly performs bubble removal flushing process (step S340) until dot omission is eliminated.

According to the ink jet printer 100B, when dot omission is detected during printing, bubble removal flushing process is performed to eliminate dot omission, so that it is possible to improve print quality.

D. Fourth Embodiment

Figure 17:
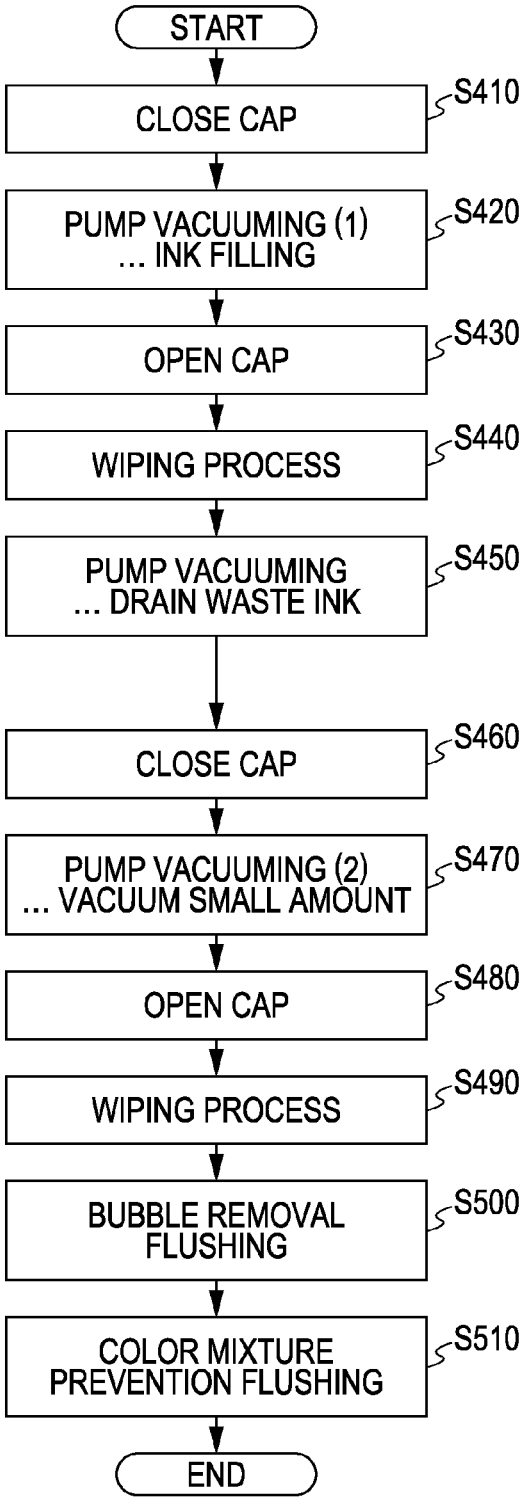
FIG. 17 is a flowchart that shows the steps of timer cleaning process according to a fourth embodiment.

FIG. 17 is a flowchart that shows the steps of timer cleaning process among maintenance processes performed by the ink jet printer according to one embodiment of the invention. The "timer cleaning process" is a process of cleaning nozzles for recovering the performance of nozzles and is periodically performed by the control unit when the ink jet printer is not performing printing process. Note that the configuration of the ink jet printer according to the fourth embodiment is the same as that of the ink jet printer 100B (FIG. 15) of the third embodiment.

The processes of step S410 to step S450 shown in FIG. 17 are performed as in the same manner as those of the first filling process (step S110 to step S150) described with reference to FIG. 12. In addition, the following processes of step S460 to step S490 are performed as in the same manner as those of the small amount filling process (step S210 to step S240) shown in FIG. 12. However, vacuuming time and vacuuming amount by the pump 43 are different from those of the initial filling process shown in FIG. 12.

Figure 18:
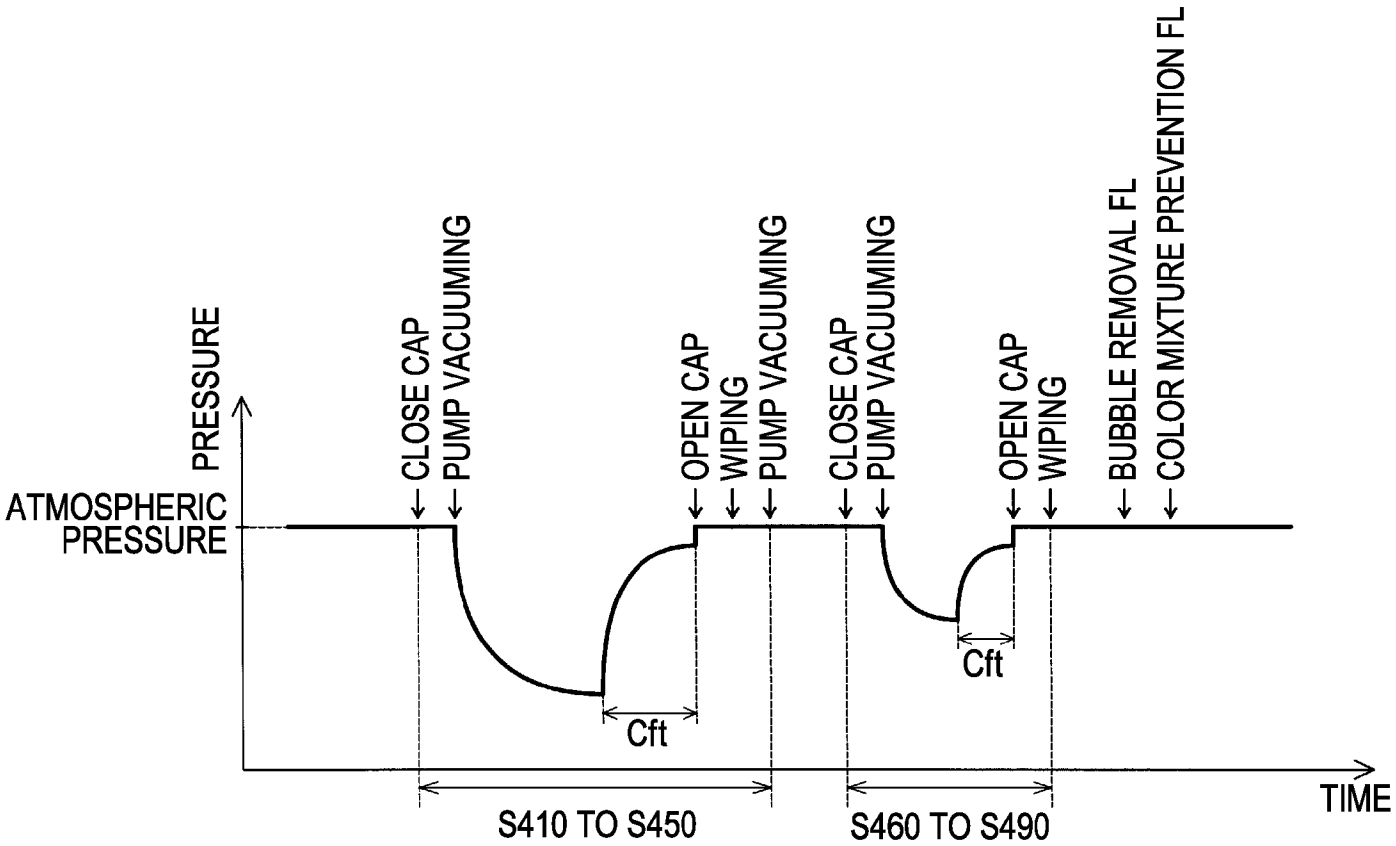
FIG. 18 is a graph that shows a pressure change in a cap closed space when the timer cleaning process is being performed.

FIG. 18 is a graph that shows a change in pressure over time in the cap closed space CS in the timer cleaning process. FIG. 18 shows substantially the same as that of FIG. 13 except that the number of portions that indicate a negative pressure by vacuuming operation of the pump 43 is reduced by one.

Note that in the timer cleaning process, as in the case of the initial filling process of the second embodiment, bubble removal flushing process (step S550) is performed before color mixture prevention flushing process (step S560). Thus, as in the case of the second embodiment, it is possible to effectively perform color mixture prevention flushing process.

In this way, by performing the timer cleaning process of the fourth embodiment, it is possible to suppress dot omission and ink clogging of the nozzles 15 to thereby improve the print quality of the ink jet printer.

E. Fifth Embodiment

Figure 19:
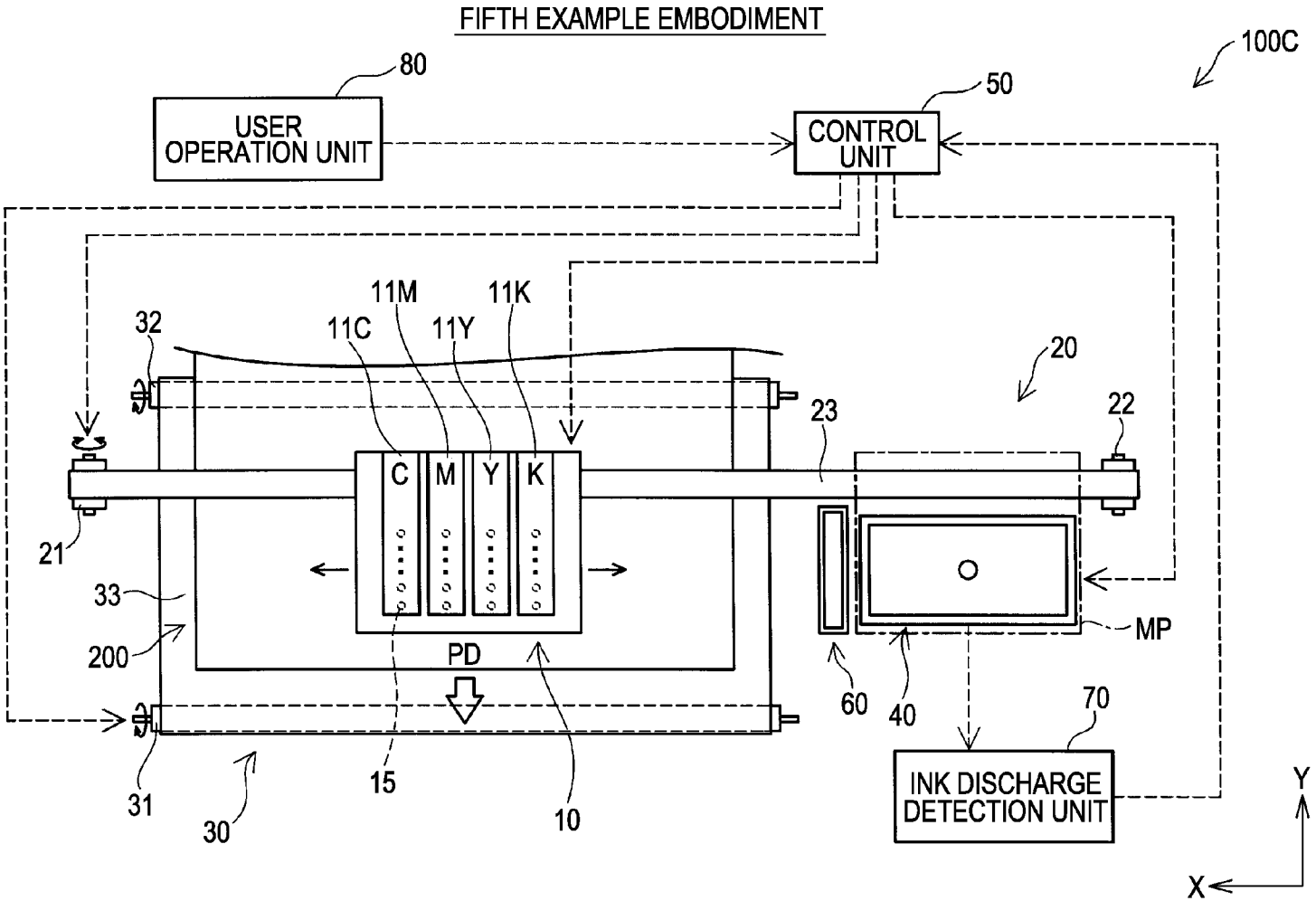
FIG. 19 is a schematic view that shows a configuration of an ink jet printer according to a fifth embodiment.

FIG. 19 is a schematic view that shows a configuration of an ink jet printer 100C according to a fifth embodiment of the invention. FIG. 19 shows substantially the same as that of FIG. 15 except that a user operation unit 80 is provided.

The user operation unit 80 is, for example, provided in the body of the ink jet printer 100C as a touch panel or an operating button. The user is able to issue an executive instruction of a process to the control unit 50 of the ink jet printer 100C through the user operation unit 80.

Figure 20:
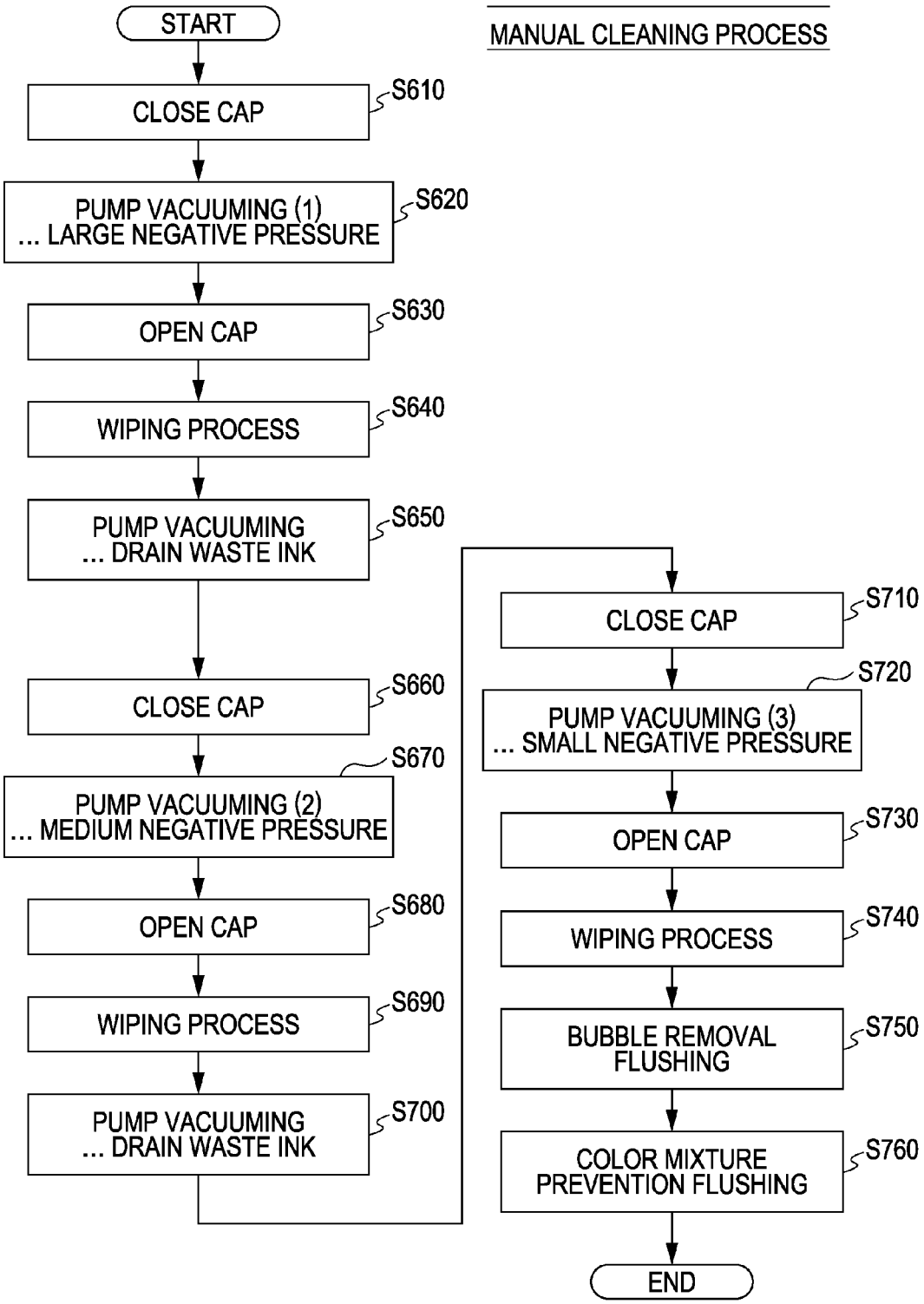
FIG. 20 is a flowchart that shows the steps of manual cleaning process.

FIG. 20 is a flowchart that shows the steps of manual cleaning process among the maintenance processes performed in the ink jet printer 100C. The "manual cleaning process" is a cleaning process for recovering the performance of nozzles and is performed by the control unit 50 when the user issues instruction through the user operation unit 80 when the ink jet printer 100C is not performing a printing process.

In step S610 to step S650 shown in FIG. 20, the same processes as those of the first filling process (step S110 to step S150) shown in FIG. 12 are performed. In the following step S660 to step S700, the same processes as those of step S610 to step S650 are repeatedly performed. In step S710 to step S740, the same processes as those of step S610 to step S640 are performed. That is, in the manual cleaning process, an ink vacuuming process is performed three successive times in a row. However, in the manual cleaning process, the amount of ink vacuumed is gradually reduced in each ink vacuuming process.

Figure 21:
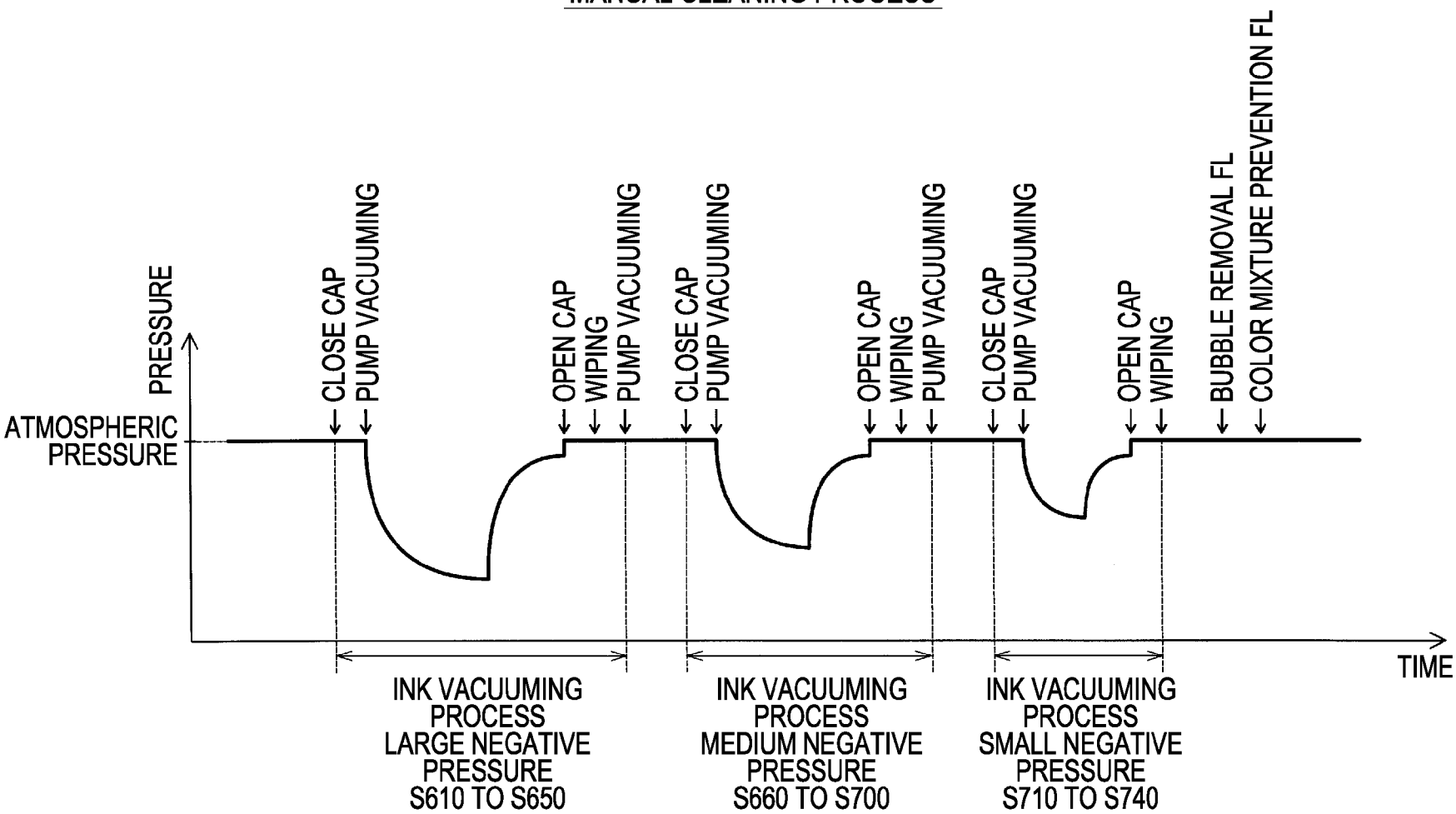
FIG. 21 is a graph that shows a pressure change in a cap closed space when the manual cleaning process is being performed.

FIG. 21 is a graph that shows a change in pressure over time near the nozzles 15 in the manual cleaning process. FIG. 21 shows substantially the same as that of FIG. 13 except that a negative pressure level is varied for each ink vacuuming process. In this way, by reducing the ink vacuuming amount while performing ink vacuuming process multiple times, it is possible to suppress the amount of ink used in the cleaning process while effectively performing nozzle cleaning process.

After performing ink vacuuming process three times, the control unit 50 performs a bubble removal flushing process (step S720 to step S730) before color mixture prevention flushing process as in the case of the initial filling process (FIG. 12) of the second embodiment. That is, even in the manual cleaning process as well, it is possible to suppress occurrence of dot omission through bubble removal flushing process, while effectively performing a color mixture prevention flushing process.

According to the ink jet printer 100C, by performing the nozzle cleaning process in response to user's arbitrary request, it is possible to improve the print quality.

F. Sixth Embodiment

Figure 22:
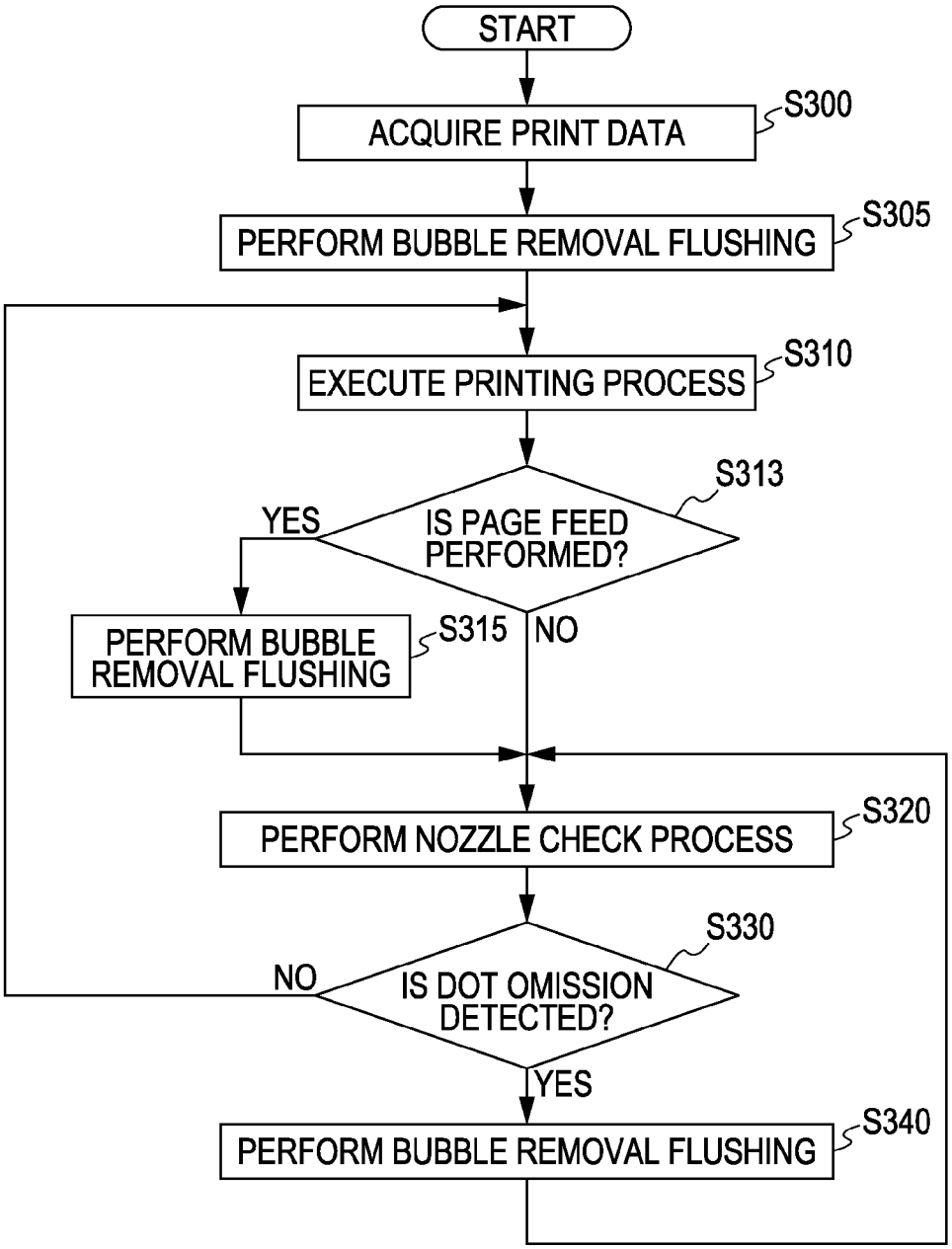
FIG. 22 is a flowchart that shows the steps when printing is being performed by an ink jet printer according to a sixth embodiment.

FIG. 22 is a flowchart that shows the steps performed by the control unit when printing is performed by the ink jet printer according to one embodiment of the invention. FIG. 22 shows substantially the same as those of the steps (FIG. 16) performed by the control unit 50 when printing is performed as described in the third embodiment except that step S305 and step S313 to step S315 are added. Note that the configuration of the ink jet printer of the sixth embodiment is the same as that of the ink jet printer 100B (FIG. 15) of the third embodiment.

Upon receiving print data together with print executive instruction from an external computer, or the like, in step S300, the control unit 50 moves the print head unit 10 to the maintenance position MP to perform a bubble removal flushing process (step S305) before initiation of printing process. In addition, during printing, when page feed is performed in order to continuously print on a consecutive sheets of paper (step S313), the print head unit 10 is moved again to the maintenance position MP to perform bubble removal flushing process (step S315). Furthermore, as in the case of the third embodiment, when the ink discharge detection unit 70 detects dot omission, a bubble removal flushing process is performed (step S320-S340).

Thus, when printing is performed, because a bubble removal flushing process is performed at a predetermined intervals, it is possible to reduce occurrence of potential dot omission and furthermore it is possible to improve print quality.

G. Alternative Embodiments

Note that the aspects of the invention are not limited to the embodiments or embodiment described above, but they may be modified into various alternative embodiments without departing from the scope of the appended claims. The following alternative embodiments are, for example, applicable.

G1. First Alternative Embodiment

In the above embodiments, the ink jet printer is described; instead, the aspects of the invention may also be applied to a fluid ejecting apparatus that discharges other fluid (liquid).

G2. Second Alternative Embodiment

In the above embodiments, the pulse width of the second pulse portion Pwh of the drive pulse 300 (FIG. 4) is set depending on the natural period of a bubble. Instead, a selected pulse width may be set. In addition, the ambient temperature may be detected when the bubble removal flushing process is performed and then the pulse width of the second pulse portion Pwh is set on the basis of the detected ambient temperature.

G3. Third Alternative Embodiment

In the above embodiments, ink droplets are idly discharged 3000 times as successive flushing set (FIG. 3); instead, ink droplets may be idly discharged selected number of times. In addition, in each successive flushing set, the drive pulse 300 is generated continuously with the same period; instead, it may be generated with a changed period.

G4. Fourth Alternative Embodiment

In the above embodiments, the pulse width of the second pulse portion Pwh of the drive pulse 300 (FIG. 4) is varied for each successive flushing set; instead, successive flushing set may be repeated with the same pulse width of the second pulse portion Pwh.

G5. Fifth Alternative Embodiment

In the above embodiments, each successive flushing set is formed of a plurality of drive pulses 300 having the same waveform; instead, the successive flushing sets may include respective drive pulses of which at least portion of waveform is different from one another. For example, each successive flushing set may include, in addition to the drive pulse 300, a drive pulse 300 having a different pulse width of the second pulse portion Pwh or a drive pulse 300 having a different voltage value Vh.

G6. Sixth Alternative Embodiment

In the above third embodiment, when the ink discharge detection unit 70 detects dot omission, a bubble removal flushing process may be performed (step S330 to step S340 in FIG. 16). Instead, another maintenance process may be performed together with a bubble removal flushing process. For example, a color mixture prevention flushing process may be performed subsequently.

G7. Seventh Alternative Embodiment

In the fifth embodiment, the user operation unit 80 is provided in the body of the ink jet printer 100C; instead, it may be implemented through a program executed on an external computer connected to the ink jet printer 100C.

What is claimed is:

1. A flushing method for discharging fluid from a fluid ejecting apparatus comprising a pressure chamber filled with a fluid, a pressure generating element provided over a surface of the pressure chamber which is capable of changing the pressure of the pressure chamber by deforming the surface of the pressure chamber, and a nozzle that is in fluid communication with the pressure chamber which is capable of ejecting the fluid, the flushing method comprising:

repeatedly performing a first flushing process at intervals corresponding to a first period, the first flushing process comprising:

generating a negative pressure in the pressure chamber by driving the pressure generating element to cause the pressure chamber to expand into an expanded state, wherein the pressure generating element is driven by a first pulse portion of a first drive pulse, the first pulse portion having a pulse width determined by a Helmholtz resonance period of the fluid in the pressure chamber;

maintaining the expanded state, wherein the expanded state is maintained by driving the pressure generating element with a second pulse portion of the first drive pulse, the second pulse portion having a pulse width determined by a first target diameter of one or more bubbles in the fluid in the pressure chamber that are to be ejected from the pressure chamber; and discharging the fluid from the nozzle by contracting the pressure chamber from the expanded state, wherein the pressure chamber is contracted by driving the pressure generating element with a third pulse portion of the first drive pulse, the third pulse portion having a pulse width that is substantially equal to a natural frequency of the pressure generating element; and repeatedly performing a second flushing process after repeatedly performing the first flushing process at intervals corresponding to a second period, wherein the second flushing process comprising:

generating a negative pressure in the pressure chamber by driving the pressure generating element to cause the pressure chamber to expand into an expanded state, wherein the pressure generating element is driven by a first pulse portion of a second drive pulse, the first pulse portion having a pulse width determined by the Helmholtz resonance period of the fluid in the pressure chamber;

maintaining the expanded state, wherein the expanded state is maintained by driving the pressure generating element with a second pulse portion of the second drive pulse, the second pulse portion having a pulse width determined by a second target diameter of the one or more bubbles in the fluid in the pressure chamber, the second target diameter being a different size than the first target diameter; and discharging the fluid from the nozzle by contracting the pressure chamber to contract from the expanded state, wherein the pressure chamber is contracted by driving the pressure generating element with a third pulse portion of the second drive pulse, the third pulse portion having a pulse width that is substantially equal to the natural frequency of the pressure generating element, wherein the pulse width of the second pulse portion of the second drive pulse is shorter than the pulse width of the second portion of the first drive pulse, and wherein the pulse width of the second pulse portion of the first or second drive pulse is set to be shorter for each successive period following first periods of each of the first and second drive pulses.

2. The flushing method according to claim 1, the flushing method further comprising applying a negative pressure to the nozzle to vacuum the fluid after a cartridge containing the fluid is mounted on the fluid ejecting apparatus and wiping the area of the nozzle off prior to performing the first flushing and the second flushing processes.

3. The flushing method according to claim 1, wherein the first period is shorter than the second period.

4. The flushing method according to claim 1, wherein the pulse widths of the first pulse portion of the first drive pulse is set to be shorter than half of a Helmholtz resonance period of the fluid in the pressure chamber.

5. The flushing method according to claim 1, wherein the fluid ejecting apparatus further comprises a fluid discharge detection unit capable of detecting the discharge of the fluid from the nozzle, wherein the first flushing process is performed when the amount of discharged fluid detected by the fluid discharge detection unit is less than a predetermined value.

6. The flushing method according to claim 1, wherein the first flushing process is performed at a predetermined time interval or in response to user's instruction.

7. The flushing method according to claim 1, wherein the fluid ejecting apparatus comprises an ink jet printer, and the first flushing process is performed when the ink jet printer initiates a printing process and between printing on consecutive sheets of paper in a single printing process.

8. The flushing method according to claim 1, wherein the pulse widths of the first pulse portion of the second drive pulse is set to be shorter than half of a Helmholtz resonance period of the fluid in the pressure chamber.

9. The flushing method according to claim 4, wherein the pulse widths of the first pulse portion of the second drive pulse is set to be shorter than half of a Helmholtz resonance period of the fluid in the pressure chamber.

* * * * *